US005910268A

United States Patent [19]

Keefer

[11] Patent Number: 5,910,268

[45] Date of Patent: Jun. 8, 1999

[54] MICROWAVE PACKAGING STRUCTURES

[76] Inventor: Richard M. Keefer, 221 Hayes Line R.R. #2, Omemee, Ontario, Canada, K0L 2W0

[21] Appl. No.: 09/064,141

[22] Filed: Apr. 22, 1998

Related U.S. Application Data

[60] Division of application No. 08/529,074, Sep. 15, 1995, and a continuation-in-part of application No. 08/458,419, Jun. 2, 1995, abandoned.

[51] Int. Cl.[6] ..... H05B 6/80

[52] U.S. Cl. ..... 219/728; 219/730; 99/DIG. 14; 426/107; 426/234

[58] Field of Search ..... 219/728, 729, 219/730, 759, 734, 735; 426/107, 109, 234, 243; 99/DIG. 14

[56] References Cited

U.S. PATENT DOCUMENTS

| | | | |
|---|---|---|---|
| 4,814,568 | 3/1989 | Keefer | 219/728 |
| 4,990,735 | 2/1991 | Lorenson et al. | 219/728 |
| 5,117,078 | 5/1992 | Beckett | 219/729 |
| 5,260,537 | 11/1993 | Beckett | 219/728 |
| 5,354,973 | 10/1994 | Beckett | 219/730 |
| 5,412,187 | 5/1995 | Walters et al. | 219/728 |
| 5,519,195 | 5/1996 | Keefer et al. | 219/728 |

*Primary Examiner*—Philip H. Leung
*Attorney, Agent, or Firm*—Jane Parsons

[57] ABSTRACT

Active elements are described which modify the heating of foodstuffs and other microwave-heatable loads and which are responsive to changes of load dielectric properties with temperature or as a result of changes of state, composition or density during heating, to the presence of absence of loads, and to the presence or absence of adjacent dielectric materials. The active elements, which may be looped slots or strips, are constituted so as to be or become resonant or non-resonant during microwave heating of the load in response to the presence or absence of the load or the presence or absence of adjacent dielectric material. The elements conveniently may be constructed of electroconductive metal or artificial dielectric material.

11 Claims, 14 Drawing Sheets

MICROWAVE PACKAGING STRUCTURES

REFERENCE TO RELATED APPLICATION

This application is a divisional application of copending of U.S. patent application Ser. No. 08/529,074 filed Sep. 15, 1995 and a continuation-in-part of U.S. patent application Ser. No. 08/458,419 filed Jun. 2, 1995 (now abandoned).

FIELD OF INVENTION

The present invention relates to structures for modifying the microwave heating of foodstuffs and other microwave absorptive loads, and to methods of using and manufacturing such structures. More particularly, the present invention relates to structures for modifying the power absorption or heating distributions of foods and other microwave loads, for providing selective heating therein, and for intensifying heating at the surfaces of these loads. This invention also relates to structures offering control of the microwave heating process through the sensitivity of such structures to load design, composition, and physical properties, and to the presence or absence of loads. The loads whose microwave heating will most commonly be modified are foodstuffs, and much of the following description therefore relates to foodstuffs. However, it will be understood that the present invention encompasses in its broader aspect modification of the microwave heating of bodies composed of any microwave-heatable substance.

BACKGROUND TO THE INVENTION

Despite the convenience of heating offered by the microwave oven, the commercial success of many microwavable food products has been limited by their unevenness of heating, and by the inability of their packaging to control power absorption, provide selective heating, or yield consistent browning and crisping results. For food loads shaped as slabs, non-uniform heating is widely observed as hot peripheries and cold central regions, and as patterns of lobe-like hot spots. In frozen foods, the unevenness of product temperature distributions is exacerbated by an enthalpy requirement of thawing that can exceed the energy needed to bring the food once thawed to a typical target temperature of about 70° C. When an uneven deposition of microwave energy is applied to the combined enthalpy requirements of heating a frozen food, larger temperature variations are observed than in the heating of refrigerated products. Temperatures measured at the edges of the food will often exceed 100° C. before its central regions have thawed. On the extended heating of frozen and refrigerated foods, temperatures tend to cluster near 100° C. because of a large evaporative energy requirement in the range of 2,260 J per gram of weight loss. While this clustering of temperatures may give the semblance of improved heating uniformity, uneven energy deposition instead appears as weight loss variations over the food cross-section. Total weight losses, expressed as a proportion of the initial weight of a product, will often obscure high localized moisture losses rendering the edges of the product tough or unpalatable.

Non-uniform heating of a variety of loads ranging from frozen and refrigerated foods to ceramics can be better understood by considering the loads when in microwave-transparent containers as dielectric resonators, and those in metal-walled containers as filled waveguide or cavity resonator systems. Multiple reflections at the interfaces of a load and the air of a surrounding cavity, or at the metal walls of a container, combine to give constructive or destructive interference between opposing faces of the load. Constructive interference can be referred to as resonance (or in an adjectival sense, as resonant), and destructive interference as anti-resonance (or adjectivally, anti-resonant). For convenience, the term "resonator" herein refers to structures supporting resonant or anti-resonant effects. In simple resonator geometries, the field distributions resulting from multiple reflections can be resolved as modes, or eigenvector solutions of Maxwell's equations with characteristic eigenvalues.

There is extensive literature describing the properties and applications of dielectric resonators, as exemplified by the edition of D. Kajfez and P. Guillon, *Dielectric Resonators*, Artech House, 1986. Dielectric resonators are typically formed from ceramics, such as $TiO_2$ and titanates. Air-filled metallic waveguide and cavity structures are widely used in the art, and their properties are discussed in such texts as N. Marcuvitz, *Waveguide Handbook*, first published by McGraw-Hill in 1951 and reprinted by Peter Peregrinus, 1986. In general, waveguide and cavity walls are chosen to be highly conductive, and the art-recognized assumption of walls that are perfect electric conductors allows the enclosed field distributions to be described by means of individual or superposed waveguide modes. The transverse field distributions of metal-walled containers resemble those of the corresponding metallic waveguide or cavity cross-sections. However, in contrast with air-filled waveguide, load dielectric constants greater than unity permit the propagation in metal-walled containers of high order modes that would ordinarily be rapidly attenuated. For loads in microwave-transparent containers, the assumption of perfectly magnetically conducting walls allows field distributions in their bulk regions to be approximated using a similar set of waveguide modes.

The resonances of food loads in microwave-transparent and metal-walled containers are discussed in a paper by R. M. Keefer The Modelling of Foods as Resonators, *In Predicting Microwave Heating Performance*, given at the 22$^{nd}$ Annual Symposium of the International Microwave Power Institute, 1987, and also in the article, R. M. Keefer, *The Role of Active Containers in Improving Heating Performance in Microwave Ovens*, Microwave World 7(6), 1986. The presence of higher order modes and their superposition allows load field distributions and energy deposition to respond flexibly to the boundary conditions imposed by the container and its surroundings. Unfortunately, this responsiveness also leads to an undesirable sensitivity of load heating distributions and power absorption to design of the surrounding cavity and positioning of the load within it. When combined with the large number of consumer microwave ovens, this sensitivity causes many microwavable foods to perform unreliably in delivering the desired sensory attributes, or in exceeding the minimum temperatures needed for microbiological safety.

While waveguide modes offer a useful approximate description of load field distributions and energy deposition transversely to the walls of microwave-transparent or metal-walled containers, it is important to note that the assumption of perfectly electrically conducting or perfectly magnetically conducting walls confines their dependence on load dielectric properties to the perpendicular part of the corresponding waveguide solutions. In other words, the transverse part of the waveguide solutions varies harmonically with the load cross-section, but not with the load dielectric constant. In the dependence of the structures of the present invention on load dielectric properties and the presence or absence of a load, this leads to important distinctions over the prior art. Many practical loads are shaped as slabs, that is, with at least one set of opposing faces in a substantially plane-parallel relationship. When describing propagation through or between a single such set of opposing faces, "vertical" herein refers to the direction perpendicular to the faces, although it will be understood that the present invention is not limited to any particular orientation of loads within an enclosing microwave cavity. The dependence of the vertical part of waveguide solutions on load dielectric properties has been described in the art in reference to vertical variations of power absorption. Variations of power absorption in the vertical axis of metallic containers were observed in a paper by R. M. Keefer, *Aluminum Containers for Microwave Oven Use*, in the Proceedings of the 19$^{th}$ Annual Meeting of the International Microwave Power Institute, 1984, pp. 8–12. They were also described in U.S. Pat. No. 4,990,735 to C. Lorenson et al (issued Feb. 5, 1991), incorporated by reference herein. According to Lorenson et al, load power absorption shows strong vertical variations, with maxima and minima repeating on an interval determined from the real and complex parts of the load relative dielectric constant. For convenience of description, the term "vertical resonances" herein refers to vertical variations of power absorption through one or more layers of a load. The transverse field distributions described in this patent are primarily attributed to harmonic considerations such as the order of the modes in a transverse sense, or the presence of reflective mode-clamping structures. In the context of lossy dielectric slabs, vertical variations were referred to in an article by W. Fu and A. Metaxas, *A Mathematical Derivation of Power Penetration Depth for Thin Lossy Materials*, Journal of Microwave Power, 27(4), 1992, pp. 217–222, incorporated by reference herein. This article also shows the concept of penetration depths used in describing load power absorption to be applicable only to loads "so thick that one can neglect the effects caused by waves reflected from the material boundaries."

The principles of geometrical optics are also instructive in understanding the present invention. The applicability of these principles to microwave problems can be seen from such texts as G. L. Lewis, Geometric Theory of Diffraction for Electromagnetic Waves, Peter Peregrinus, 1976. Snell's law of refraction provides that for loads with high dielectric constants, energy penetrating the surfaces of the loads will be directed nearly perpendicularly thereto for a wide range of angles of incidence (i.e. modes). Consistent with this observation, multiple transverse mode structures can produce similar vertical variations in high dielectric constant loads such as foods in the thawed state. Even when the individual modes cannot be readily distinguished in transverse heating distributions, simple vertical patterns of fluctuating of power absorption are often observed. Taken together with the responsiveness to applied conditions allowed by the superposition of modes, this suggests that the vertical part of the waveguide solutions provides the main restriction in determining such heating effects as overall power absorption.

The importance of dielectric properties in determining heating performance follows from the foregoing discussion of load resonances. In lossless metal-walled cavities, the resonant frequency of each mode is proportional to the inverse square root of the dielectric constant, although this is only approximately true for dielectric resonators. At a fixed frequency, changes of dielectric constant shift the dominant modes into or out of resonance, or promote the propagation of other modes. Frequency-stability is a design goal of resonators used in filter circuits, and dielectric materials are selected for minimal temperature-dependence in such applications. By contrast, large variations of dielectric properties are typically encountered in microwave heating applications. These can result from changes of load state or composition over the heating cycle, and for loads subject to dielectric relaxation phenomena, can be attributed to temperature-dependence both of their static dielectric constants and critical frequencies. The variation of dielectric properties with temperatures appears in a variety of articles and texts, for example, H. Frohlich, *Theory of Dielectrics: Dielectrics and Loss*, Oxford University Press, 2nd edition, 1958. From U.S. Pat. No. 4,990,735 to Lorenson et al, power absorption of a load fluctuates vertically with maxima and minima repeating on an interval determined by the real and complex parts of the load relative dielectric constant. Taking the dielectric properties of water as representative of many high water activity foods, the real part of the relative dielectric constant of water at a frequency of 2.45 Ghz varies approximately from 4.2 in the frozen state, to 82.19 in the liquid state at 0° C. and 55.32 at 100° C. The imaginary part of the relative dielectric constant of liquid water shows a nearly tenfold decrease from approximately 23.64 at 0° C. to 2.23 at 100° C. Applying such variations of load dielectric properties to the vertical intervals described by Lorenson et al, it is apparent these intervals and the corresponding power absorption will shift significantly with the temperature changes occurring over the heating cycle.

In a broad sense, the dependence of load resonances on dielectric properties leads to variability of the corresponding heating distributions and power absorption when the dielectric properties of the load are temperature-dependent. This has important consequences on the reliability of prior art structures in modifying the microwave heating of foodstuffs and other loads. As used adjectivally herein to describe microwave packaging, container, or utensil structures, "active" refers to structures incorporating microwave-reflective components intended for modifying energy deposition within an adjacent foodstuff or other load. These devices typically use such active components as patterned foil, or metallic plates or rods to provide shielding, selective heating, or localized searing effects. Additionally, susceptors and coatings containing conductive or lossy particulates are used to provide browning and crisping effects. Even for simple shielding devices found in the earlier art, an intended reduction of power absorption may be offset by the resonant enhancement of the heating caused by inadvertent selection of a resonant load thickness. Similarly, devices intended to provide increased power absorption by means of impedance-matching or coupling may fail to perform as claimed because of vertical interference effects causing a reduction of field intensities within the load. For active devices directed at a particular load or load condition, changes of dielectric properties attendant on heating may render them ineffective. These problems may be obscured by the practice of evaluating package heating performance using aqueous gel food simulants near room temperature, often without consideration of the temperature-dependence of their dielectric properties, or that such simulants are not representative of food in the frozen state. Given the large changes of dielectric constants accompanying thawing, active devices for use with frozen foods may be ineffective in modifying the heating of refrigerated foods, or the foods once thawed. Because of coupling or decoupling with load resonances, or changes in load dielectric properties over the heating cycle, devices using microwave-reflective strip components, or with reflective sheets incorporating slot or aperture perforations, may shift in or out of resonance with adverse or unforeseen consequences. In particular, on shifting into resonance, open metallic strips may arc or cause scorching of supporting materials such as paperboard. On shifting out of resonance, components dependent on the induction of strong fringing fields for browning and crisping of adjacent foods may cease to function as intended.

In response to these problems, the present invention recognizes the changes of load vertical resonances and dielectric properties occurring over the heating cycle. While extending to embodiments capable of modifying load heating performance over the entire heating cycle, it principally includes active structures that are responsive to the features of load design affecting the resonances thereof, to changes of load dielectric properties with temperature or accompanying changes of state, composition, or density over the heating cycle, to the presence or absence of loads, and to the presence or absence of adjacent dielectric materials, such as packaging, utensils or containment apparatus, or dielectric components of an external microwave cavity or oven. While changes of load resonant or dielectric properties have caused unreliable operation of prior art devices, the responsiveness of the structures of the present invention to the load and its surroundings instead provides novel features of control in modifying load heating performance.

PRIOR ART

A variety of prior art packaging and utensil designs have attempted to provide improved heating uniformity, modified power absorption, selective heating, and the searing or surface browning and crisping of foods. The following discussion will help describe the improvements offered by the present invention and distinguish them over the prior art.

1. SHIELDING STRUCTURES:

U.S. Pat. No. 3,219,460 (Brown) is representative of the early use of perforated metal shields to reduce heating of an enclosed food article, or provide differential shielding of multiple food items. Both the claims and descriptive text of this patent are specific to the heating of frozen foods. The degree of shielding is determined by the number and size of its multiple slot, circular or polygonal openings. In U.S. Pat. Nos. 4,013,798 and 4,081,646 Goltsos describes additional differential shielding structures for multi-component meals. U.S. Pat. No. 4,196,331 (Leveckis et al) extends these shielding concepts to moderating bags with fully perforated conductive areas. U.S. Pat. No. 4,351,997 (Mattisson et al) introduces shielding structures at the walls of a tray, presumably for reducing the undesirable edge-heating that would be observed in the absence of such structures. The various shielding schemes described in these patents do not provide for modification of heating that is responsive to changes in the load.

U.S. Pat. No. 4,268,738 introduces the concept of a moderating structures comprised of multiple overlapping reflectors which move in relation to one another on expansion or contraction of a supporting wrap, to define apertures whose size and transmissiveness increase or decrease over the heating cycle. While such a scheme would provide varying degrees of moderation in response to changing temperatures or doneness of the load, it requires complex and concerted movement of its reflectors. The present invention does not contemplate such relative movements of its active components.

2. STRUCTURES FOR MODIFYING HEATING DISTRIBUTIONS:

U.S. Pat. No. 3,353,968 (Krajewski) teaches the use of spaced re-radiating conductive strips or rods to provide concentrated heating of foods. These strips or rods are shown to be spaced from the foods, and their resonant lengths provide intense fields capable of modifying oven and load field distributions. U.S. Pat. No. 3,490,580 (Brumfield et al) describes the use of dipole "field strength concentrators" for sterilizing medical products within sealed containers. The resonant fields of these concentrators are sufficiently intense to provide glow discharges used for sterilization. U.S. Pat. No. 3,5091,751 Patent (Goltsos) uses dipole rods for the browning of foods. High resonant currents in the rods resistively produce high temperatures that are used for the browning of adjacent foods. The resonant structures described in these patents would today be considered hazardous in their likelihood of arcing, or in the latter instance, causing burns.

U.S. Pat. No. 3,845,266 (Derby) discloses microwave utensils combining microwave permeable coupling members (i.e. pyrex or pyroceram plates) with non-permeable, non-dissipative members (i.e. metallic plates) with a plurality of spaced frequency responsive energy transmissive openings. In referring to energy transmission structures that are non-attenuating, it may be assumed these openings are well above resonance. An optional shielding cover is provided, but in practice, the use of such a cover is necessitated by the reflectiveness of the slotted metal member. In the absence of such a cover, energy would enter the food preferentially from other surfaces. Both the required transmissiveness of this member and impedance-matching of the coupling member will be affected by load resonances and by changes of load dielectric properties. The present invention does not require the coupling member described by Derby. U.S. Pat. No. 3,946,188, (Derby) provides a flexible wrap incorporating conductive heating elements with a wall height of one-quarter wavelength, extending downwardly towards a food item to be browned or seared. At a frequency of 2.45 GHz, these elements would have a height of approximately 3 cm, and would be cumbersome.

In a series of four patents, MacMaster et al provide browning utensils based on the induction of intense pi-mode or fringing fields adjacent to a food article. In U.S. Pat. Nos. 3,857,009 and 3,934,106, fringing fields are obtained by the use of spaced parallel plates of high dielectric constant, parallel plates of alternatingly high and low dielectric constant, and by spaced transmission lines comprising conductive strips on opposing faces of parallel dielectric plates. In U.S. Pat. No. 3,946,187, fringing fields are instead obtained by the use of folded, conductive members with a height of one-quarter wavelength, while U.S. Pat. No. 3,941,968 uses low dielectric constant bars that are metallized on three faces to provide such fringing fields for browning. These patents do not disclose methods of rendering their browning structures responsive to changes in the load.

Another method of providing browning and crisping effects is set out in the European patent application EPA 0 382 399 (Keefer et al), and in the paper A. Bouirdene, A. Ouacha, S. Lefeuvre, and J. Keravec, *Microwave Browning of Foods*, KEMA High Frequency/Microwave Processing Conference, 1989. In both instances, heating is concentrated at the surfaces of an adjacent food by means of evanescent propagation. Evanescent propagation refers to modes that are of sufficiently high order as to be in cut-off within the food load. Their intensity decays exponentially on penetration into the load, allowing heating to be concentrated at the load surfaces. The loops, slots and other structures described under EPA 0 382 399 are dimensioned to give propagation that is evanescent or below cut-off in an adjacent food. Changes in the dielectric properties of a food will have two effects on such structures. Firstly, the large increase of dielectric constants generally accompanying the thawing of foods may cause propagation to shift from evanescent to non-evanescent, so that the structures will no longer function as intended. Secondly, because the dielectric constants of thawed foods typically decrease with temperature, propagation will be further shifted into the evanescent region, with a likely decrease in the field intensities needed for browning and crisping. By contrast, structures of the present invention differ in the important respect that they are dimensioned to provide propagation that is above cut-off. This enables them to interact with vertical resonances of the load, and in some cases, provide shifts of heating distributions over the vertical axis. Since their propagation is non-evanescent, they offer benefits that extend well beyond browning and crisping effects.

Other structures for providing browning and crisping effects not based on the use of susceptors are disclosed in U.S. Pat. No. 5,117,078 (Beckett). This patent describes the use of a multiplicity of elongate apertures to provide intense heating at the periphery of the apertures. This intense heating is intended for the browning of adjacent foodstuffs. Optimal lengths for achieving the desired browning are not disclosed, nor are predictive relationships given for determining such optimal lengths with respect to food composition, and changes of food dielectric properties over the heating cycle. The present invention makes the important discovery of identifying how slot lengths in these and similar structures can be optimized in relation to load properties. Resonances can exist over the length of such slots, determined by coupling with the resonances of an adjacent load, by load dielectric properties, and by the presence or absence of such external structures as the dielectric trays or floors of consumer microwave ovens. The identification of slot resonances in relation to such effects offers non-obvious improvements in the performance and reliability of such structures, and in facilitating their design.

An additional structure for browning foods can be found in the GDR Industrial Patent 210200 (Grummt et al). This patent describes closed metallic loops embedded in a ceramic browning utensil. These loops are preferably comprised of poorly microwave-reflecting (i.e. resistive) metal and are dimensioned in accordance with the wavelength of the microwave oven used. Contrary to the operation of such browning utensils, it is instructive to note that an object of the present invention is to provide structures that detune in the absence of food. Grummt et al do not disclose changes in loop dimensions with the presence or absence of food, or in response to changes of food properties over the heating cycle.

A variety of prior art structures are directed at other microwave heating problems. U.S. Pat. No. 4,133,996 (Fread) discloses an apparatus for cooking raw shelled eggs incorporating opposing upper and lower microwave-reflective annular shields. Other than describing these structures as shields, there is no teaching to special relationships with the load or its properties that would allow dimensions to be determined for other systems. U.S. Pat. No. 4,320,274 to (Dehn) describes the use of monopole or T-end pickup probes coupled with meandering or patterned conductors intended for concentrating microwave energy in the central regions of a utensil. While the present invention contemplates coupling between its active components and with the load, it does not use pickup probes intended for coupling of energy from the oven field and redirecting it to a utensil. Principles similar to Dehn are applied in the more recent U.S. Pat. No. 5,322,984 to (Habeger, Jr. et al). These structures combine an antenna member with a transmission portion providing sufficiently intense fields for grilling or crisping. The impedance of dipole antenna members is impedance-matched to a distinct transmission portion to minimize reflection and reradiation by the antenna. The present invention does not incorporate such distinct antenna and transmission components for grilling or crisping.

Another set of prior art structures provide for the modification of power absorption and cross-sectional heating distributions. U.S. Pat. No. 4,656,325 (Keefer) discloses structures for coupling microwave energy more efficiently into loads, analogously with the non-reflective coatings of optics. As distinct from earlier impedance-matching dielectric slabs, these structures incorporate an air gap, allowing them to achieve coupling and browning and crisping effects without directly contacting the food surface. The structures for providing such non-reflective coupling include arrays of metal islands, artificial dielectrics, and other dielectric materials. The arrays of metal islands function essentially as reactive sheets with capacitative coupling across the gaps and slots separating the islands. This causes such arrays to provide similar reflectance to sheets composed of high dielectric constant material. Of particular interest to the present invention is the use of artificial dielectrics, also described in the article, M. Ball, R. M. Keefer, C. Lacroix, and C. Lorenson, *Materials Choices for Active Packaging*, Microwave World 14(1), 1993. They are used herein in a manner different both from this patent and the referenced publication.

Other patents refer to the modification of cross-sectional heating distributions by accentuation of the propagation of higher order waveguide-type modes. Distances between the heating maxima and minima of such higher order modes are generally smaller than those in the unmodified loads, facilitating heat conduction from relatively hot to cold regions. The accentuation of higher order modes also enables energy deposition to be differentially varied over the cross-section of an individual food item, and between the items of a multi-component meal. U.S. Pat. No. 4,866,234 to (Keefer) discloses the use of metal plates or apertures whose cross-section is either harmonically related to, or conformal with the cross-section of the load or its container. U.S. Pat. No. 4,814,568 improves on such structures by providing a more diffuse augmentation of higher order mode propagation, together with mode-stirring effects resembling those of many consumer microwave ovens. In U.S. Pat. No. 4,888,459 to (Keefer), the use of metal plates and apertures is replaced by dielectric structures with differing dielectric constants or thicknesses, while in U.S. Pat. No. 4,831,224, also to (Keefer), higher order mode propagation is accentuated by means of stepped structures whose cross-sections are harmonically or conformally related those of the load or container. The present invention provides important improvements over these patents. Firstly, the cross-sections of its active components are not restricted by the requirement that they be harmonically or conformally related to the load or container. Under the present invention, it has been discovered that such components as open and closed strips, patches, open or closed (i.e. annular) slots, or apertures can be combined to form active structures resembling circuits, with properties distinct from their comprising elements. The cross-sections of these combined structures no longer bear a simple harmonic or conformal relationship with the geometry of the container or load. Secondly, the active components of the present invention have resonances of a different nature from the higher order waveguide modes referred to under these patents. The transverse properties of waveguide modes are determined primarily by the cross-sectional boundaries of the system, and are in a mathematical sense independent of the load dielectric properties. Contrastingly, the active components of this invention interact with a variety of loads to provide improved heating performance. Additionally, it has been discovered that structures that are resonant in the one-dimensional sense precluded under the referenced patents can provide desirable modifications of heating. While these patents related external and internal cross-sections of their higher order mode-generating structures to transverse modal boundaries of the load or container, the present invention provides for structures that are resonant in a one-dimensional or lineal sense. The dimensions of annular structures configured to be resonant in a circumferential sense are in general distinct from the dimensions that would be selected to provide harmonic cross-sectional interactions.

As an extension from the higher order mode-generating structures just described, U.S. Pat. No. 4,990,735 (Lorenson et al) describes structures for the clamping of modes based on the positioning of reflective structures at the nodes or boundaries of waveguide-type modes. These nodes or boundaries are determined harmonically from the load cross-section, and their effect is augmented by the selection of load depths providing resonant enhancement of the vertical parts of the modal solutions. When applied to the use of reflective loops, the circumferential length of such loops is essentially equivalent of that of the modal boundaries clamped. However, the harmonic cross-sectional dependence of these boundaries forces their dimensions to assume discrete values determined by eigenvalues of the corresponding waveguide modal solutions. For the waveguide solutions described, the transverse parts of these solutions are independent of load dielectric properties, and the dependence on such properties is instead assumed by the vertical part of the solutions. By contrast, the present invention embraces discoveries relating to loops resonantly affected by load dielectric properties, by changes of such properties over the heating cycle, and by the presence or absence of a load. The resonances within such loops are generally precluded by the circumferential dimensions required by clamping structures, and the present invention does not seek to achieve clamping effects of the nature described under Lorenson et al.

3. SUSCEPTORS:

There is a large volume of art directed at the browning and crisping of foods obtaining browning and crisping of foods using susceptors or utensils incorporating lossy coatings.

| | |
|---|---|
| U.S. Pat. No. 3,835,280 (Gades) | Rings, popcorn |
| U.S. Pat. No. 4,190,757 (Turpin) | Susceptor |
| U.S. Pat. No. 4,230,924 (Brastad) | Susceptor |
| U.S. Pat. No. 4,267,240 (Brastad) | Susceptor |
| U.S. Pat. No. 4,369,346 (Hart) | Susceptor |
| U.S. Pat. No. 4,641,005 (Seiferth) | Susceptor |
| U.S. Pat. No. 4,676,857 (Scharr) | Susceptor |
| U.S. Pat. No. 4,883,936 (Maynard) | Susceptor |
| U.S. Pat. No. 4,904,836 (Turpin) | Susceptor |
| U.S. Pat. No. 4,927,991 (Wendt) | Susceptor |
| U.S. Pat. No. 5,006,684 (Wendt) | Susceptor |
| U.S. Pat. No. 5,038,009 (Babbitt) | Susceptor |
| U.S. Pat. No. 5,079,397 (Keefer) | Susceptor |
| U.S. Pat. No. 5,160,819 (Ball) | Industrial applications |
| U.S. Pat. No. 5,173,580 (Levin) | Susceptor |
| U.S. Pat. No. 5,185,506 (Walters) | Susceptor |
| U.S. Pat. No. 5,239,153 (Beckett) | Rings, pot pie |
| U.S. Pat. No. 5,256,846 (Walters) | Susceptor |

-continued

| | |
|---|---|
| U.S. Pat. No. 5,300,746 (Walters) | Susceptor |
| U.S. Pat. No. 5,310,980 (Beckett) | Tray with reflector directing energy towards centre |

SUMMARY OF THE INVENTION

The present invention is directed to providing structures that are capable of modifying the microwave heating of foodstuffs and other microwave-heatable loads, and that are optionally responsive to features of load design affecting the vertical resonances thereof, to changes of load dielectric properties with temperature or as resulting from changes of state, composition, or density during heating, to the presence or absence of loads, and to the presence or absence of adjacent dielectric materials. As previously noted, changes of load resonant and dielectric properties during heating have caused unreliable operation of prior art devices. Accordingly, the structures of the present invention are directed to providing improved reliability and control in modifying the microwave power absorption or heating distributions of foods and other loads, for selectively heating such loads, and for intensifying heating at load surfaces. The responsiveness of these structures to changes of load properties optionally provides self-limiting features in connection with such modified heating. The ability of the structures of this invention to respond to the presence or absence of loads enables them to optionally provide increased or decreased field intensities, or modified field distributions, depending on such presence or absence thereof. Their ability to respond to the presence or absence of adjacent dielectric materials provides additional useful features. For example, the designs of the structures of this invention can be adjusted for the presence or absence of materials capable of disturbing their performance, or for changes in the properties of the materials.

The structures and methods of this invention can also be applied to modifying or improving the microwave heating performance of other active devices, such as susceptors. In combination with other prior art devices, these structures can be used with the higher order mode-generating means described under U.S. Pat. Nos. 4,814,568, 4,831,224, 4,866,234, 4,888,459, and 5,079,397 (Keefer) and incorporated herein by reference, with additional higher order mode-generating devices described under U.S. Pat. No. 4,992,638 to (Hewitt et al), incorporated herein by reference, with the browning devices of U.S. Pat. No. 5,117,078 to (Beckett), incorporated herein by reference, with the antenna devices of U.S. Pat. No. 5,322,984 to (Habeger, Jr. et al), also incorporated herein by reference, and with the microwave tunnel oven described under U.S. Pat. No. 5,160,819 (Ball), further incorporated herein by reference. When used in connection with such devices, the present invention is directed to providing structures capable of modifying or improving the microwave heating of foodstuffs and other microwave-heatable loads, and that are optionally responsive to features of load design affecting the resonances thereof, to changes of load dielectric properties with temperature or as resulting from changes of state, composition, or density during heating, to the presence or absence of loads, and to the presence or absence of adjacent dielectric materials. The structures and methods provided hereunder can also be applied to reducing arcing or scorching problems encountered in the use of prior art devices for the microwave heating of foods.

It will now be seen how the structures of the present invention are capable of responding to vertical resonances and dielectric properties of the load, to changes of load dielectric properties, to the presence or absence of loads, and the presence or absence of adjacent dielectric materials. In accordance with this invention, one or a plurality of active elements is located at or near one or more faces of a microwave-heatable load. When illuminated with microwave radiation in a microwave cavity or oven, each such active element has the property of conducting or guiding microwaves in a manner determined by the shape and composition of the element and the active structure incorporating it. Multiple reflection occurs at boundaries or discontinuities of the elements that are so disposed as to cause constructive or destructive interference of the conducted or guided microwaves. Alternatively, constructive or destructive interference can be obtained by the circuital conduction or guidance of the microwaves around closed shapes, such as annuli. When an annular element is dimensioned such that microwaves circulating from a reference point thereon are returned to the point substantially in phase, then the microwaves will interfere constructively. If they are returned to the point approximately 180° out of phase, destructive interference results. Closely associated with the conduction or guidance of microwaves by the elements hereof is the presence of induced electric and magnetic fields. These fields couple with a nearby load, and thus interact with its structure and the vertical resonances occurring therein, causing a shift of the corresponding resonant or anti-resonant dimensions. An additional shift is caused by the presence of adjacent dielectric material. Constructive interference at the elements leads to resonantly intensified fields that can be used to locally increase heating of the load, while destructive interference provides an effect similar to shielding by anti-resonantly reducing the field intensities. As the resonant and dielectric properties of the load change over the heating cycle, resonant or anti-resonant dimensions of the elements will also change as a result of the coupling of their induced fields with the load. Consequently, the elements can be dimensioned to shift into or out of resonance or anti-resonance over a desired portion of the heating cycle, and can thus be visualized as turning "on" or "off" in response to the load.

The individual active elements hereof can be combined to form structures offering additional useful properties. Multiple elements can be used as arrays for providing distributed increases or decreases of heating, can be differentially dimensioned for modifying load heating distributions or providing selective heating, or can be combined for distinct heating effects. When the elements are uncoupled, non-uniform illuminating fields will cause their performance to vary with design of the surrounding cavity and positioning within it. The effect of such non-uniform illumination can be reduced by the coupling of individual elements by direct connection of the conducting or guiding materials comprising them, or by the linkage of their fields across separating dielectric material or air gaps. Multiple elements can also be dimensioned to respond to the load at different stages of the heating cycle. For example, one element may be dimensioned to resonate when coupled to a load in a particular condition affecting its dielectric properties, while another element may subsequently resonate as the load condition and dielectric properties change with heating. Multiple elements can also be dimensioned to become anti-resonant as the load passes through a range of dielectric properties on heating.

In responding to the presence or absence of a load, active elements incorporated in the structures of this invention can be dimensioned to be anti-resonant or minimally resonant in the absence of a load, and shift into or towards resonance in the presence thereof and in coupling therewith. Field intensities at the elements are thus low in the absence of a load or if a load is not adjacent, but are sufficiently intense when one is present to modify its heating. Common materials, such as paperboard, are moderately lossy at microwave frequencies, and at high field intensities can heat rapidly enough to scorch or ignite. They are, therefore, unsuitable for use with active devices that generate intense resonant or fringing fields. By dimensioning the active elements hereof to shift into resonance in the presence of a load, the risks associated with the use of such materials in an unloaded condition can be minimized. Conversely, it is desirable in some instances to provide active devices whose associated field intensities are reduced in the presence of a load. Thus, the use of elements that are or become anti-resonant or minimally resonant in the presence of a load can be used to provide moderated heating or reduce localized overheating caused by resonances in sensitive loads.

If the presence or absence of adjacent dielectric material is not explicitly considered in the design of active devices, the effect of such devices on load heating performance can be disturbed or negated. For example, while active devices, such as susceptors, may improve heating performance at the exposed faces of a food load, they often perform poorly when contacting glass trays or ceramic floors used in microwave ovens for mechanical support and impedance-matching effects. In the present invention, coupling of the fields induced by the active elements hereof with a nearby load and adjacent dielectric material causes a shift of the corresponding resonant or anti-resonant dimensions. This shift is taken into account when dimensioning the elements, and is used to compensate for the presence of dielectric materials, such as packaging, utensils or containment apparatus, or dielectric components of a microwave cavity or oven. The present invention additionally provides for the location of active elements on indented regions of structures containing or supporting the loads, in order to isolate the elements from cavity or oven components capable of disturbing their performance.

Recapitulating from the earlier discussion of loads as resonators, microwave heating problems of the art were described with reference to transverse field distributions and vertical variations of power absorption. The use of waveguide modes for the approximate description of transverse field distributions was discussed, together with their underlying assumption of perfect electrically conducting or perfect magnetically conducting walls. This assumption confines the dependence of waveguide modes on load dielectric properties to the vertical part of the corresponding waveguide solutions. Higher order mode-generating and mode-clamping devices were seen, respectively, to accentuate the propagation of higher order waveguide modes, and to restrict by clamping and vertical effects the propagation of waveguide modes. The generation of higher order waveguide modes requires the use of structures whose cross-sections are harmonically or conformally related to the cross-section of an adjacent load or its container, while mode-clamping requires the disposition of reflective structures at the nodes or boundaries of waveguide modes determined harmonically from this cross-section. For a given load or container cross-section, the design of these devices is not directly related to the dielectric properties of the load. An essential feature of the present invention is the provision of active elements that are or become substantially resonant or anti-resonant during the microwave heating of a microwave heatable load, in response to the presence or absence of such a load, or in the presence or absence of adjacent dielectric material. A microwave heatable load is defined herein as including additional dielectric material placed against adjacent the load. Such additional dielectric material may be used to enhance or decrease changes in load dielectric and load resonance even though there is no primary interest in heating such additional dielectric material. By contrast with higher order mode-generating and mode-clamping devices of the prior art, the operation of its structures is affected by the dielectric properties of the load when one is present. While the design of such prior devices is harmonically-related to an adjacent load or container cross-section, the dimensioning of the active elements hereof necessary for their desired resonant or anti-resonant properties is substantially independent of this cross-section.

Referring next to the composition of the elements hereof, the shapes of the elements are defined by reflective boundaries that provide for the conduction and guidance of microwaves, and for the multiple reflection or circuital conduction or guidance thereof to obtain constructive or destructive interference effects. As used in its art-recognized sense, the term "constitutive parameters" refers to the individual electromagnetic parameters of electric permittivity (or dielectric properties), magnetic permeability (or magnetic properties), or electrical conductivity (or inversely, resistivity) of a substance. The reflective boundaries of the elements are formed by regions that are contiguous or separated by a thin air gap or intervening dielectric material, such that one or more constitutive parameters or the thickness is varied therebetween. The variation of constitutive parameters or thickness can be substantially stepwise or graduated between greater or lesser values, provided sufficient reflection is obtained to enable the conduction or guidance of microwaves at the elements. In the simplest instance, reflective boundaries can be obtained by the use of adjoining conductive (i.e. metallic) and dielectric regions. However, they can also be obtained by variation between regions of high and low dielectric constant, of high and low magnetic permeability, or high and low conductivity. The lower of these properties can in each case be provided by a supporting dielectric material or the surrounding air. High dielectric constants can be obtained from the use of artificial dielectrics or ferroelectrics, while high magnetic permeabilities are obtainable from ferromagnetic or ferrimagnetic substances. Suitable conductivities can be obtained by the use of susceptor or vacuum-metallized materials well known in the art. Additionally, adjacent regions of the elements can be formed as ridges or plateaus whose vertical displacement inwardly towards the load or outwardly therefrom corresponds to the elemental boundaries. Such inward or outward displacements can be stepwise or graduated, and the regions can be comprised of the same material, provided they are sufficiently reflective to guide propagation of the microwaves. When the load is fluid or can be formed to assume the shape of an adjacent container or supporting structure, inward or outward displacements of container shape can also be used to define elemental boundaries. If the container or supporting structure is minimally reflective, the dielectric properties of the load and the variations of its shape provide a similar guidance of the microwaves.

Accordingly, in one aspect of the present invention, there is provided an active element capable of modifying the microwave heating of a microwave heatable load and having:

a shape defined by microwave-reflective boundaries that provide conduction and guidance of microwaves and multiple reflection or circuital conduction or guidance of microwaves to obtain constructive or destructive interference effects, and a shape which is or becomes substantially resonant or non-resonant during microwave heating of the microwave-heatable load in response to the presence or absence of such load or to the presence or absence of adjacent dielectric material.

In another aspect of the invention, there is provided a method of heating a microwave-heatable body by microwave radiation, which comprises:

positioning at least one active element at least proximate to one or more faces of a microwave-heatable load which is capable of having its resonant and/or dielectric properties changed upon exposure to microwave radiation, each said active element having a shape defined by microwave-reflective boundaries that permit conduction and guidance of microwaves and multiple reflection or circuital conduction or guidance of microwaves to obtain constructive or destructive interference effects, each said active element having a shape which is or becomes resonant or non-resonant during microwave heating of the microwave-heatable load in response to the presence of said load, and exposing said microwave-heatable load and said at least one active element to a heating cycle of microwave radiation to heat the load and to couple electric and magnetic fields induced in said at least one active element with said microwave-heatable load, so that said field coupling interacts with the structure and vertical resonances of said microwave-heatable load and causes a shift of the resonance or anti-resonant dimensions of said at least one active element and, as the resonant and dielectric properties of the load change during the heating cycle, the resonant or anti-resonant dimensions of the at least one active element change such as to shift into or out of resonance or anti-resonance during a predetermined portion of the heating cycle.

Although the present invention is described herein specifically with respect to the microwave cooking of foods, the active structures described herein also may be used to provide more uniform or controlled heating in the microwave pasteurization or sterilization of foodstuffs, or in the tempering or thawing of frozen foods. Other potential applications of the active structures include drying application, the treatment of various agricultural and food commodities, wood, pharmaceuticals and chemicals. Chemical applications include the enhancement of reaction rates and the offsetting of endothermalicity. Other potential applications are softening or fusing of plastic materials, curing of resins and heat treatment of ceramics.

DETAILED DESCRIPTION OF THE INVENTION

Figure 1:
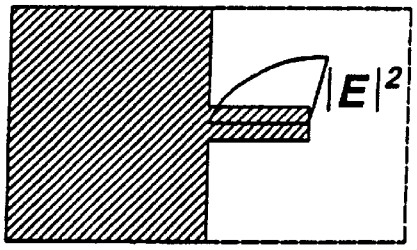
FIG. 1 shows a shape of an active element of the strip and slot type which may be used in the formation of microwave packaging structures in accordance with the invention.

The present invention provides microwave packaging structures in which the dielectric properties of the foodstuff or other load contained within the package are taken into consideration. Microwavable foodstuffs are considered as three-dimensional resonant objects and a greater weight is assigned to interference effects in the vertical axis of the foodstuff than to resonances observed over short distances. The present invention specifically takes into account food composition, heating condition, geometry and surroundings.

The packaging concepts provided herein are applicable to a wide range of practical structures, based on their response to the presence or absence of food and also to changes of food state, composition and temperature. The principles of the present invention may be used to modify microwave. heating distributions, for browning and crispening, to increase or decrease power absorption, for dielectric heating of multi-component meals and to provide combinations of these properties.

The ability herein to turn structures "on" and "off" upon achieving resonant or anti-resonant conditions in response to the food can be applied to preventing scorching in unfilled containers, to modifying susceptor performance, and to increasing the effectiveness of browning and crisping devices. The incorporation of these structures as anti-resonant structures in sidewalls also is useful in reducing the scorching problems of composite metal-walled structures. The resonant structures tend to enhance the heating of the food by intensifying the microwave energy reaching the food while the anti-resonant structures tend to decrease the heating of the food by attenuating the microwave energy reaching the food.

Accordingly, by employing basic design principles as outlined herein to take into account the various factors described above, the present invention enables precise and repeatable control of the microwave cooking of a foodstuff to a design specification to be achieved.

As discussed earlier, the present invention is concerned with the provision of active elements capable of modifying the microwave heating of a microwaveheatable load, particularly a foodstuff, having a particular shape. One feature of this shape is that the active element is or becomes substantially resonant or non-resonant during microwave heating of the microwave heatable load in reference to the presence or absence of such load or the presence or absence of adjacent dielectric material.

The active elements provided herein may be defined in terms of their effective transverse wavenumber p. (A theoretical discussion of the structures provided herein and the mathematical relationship pertaining thereto is contained in the Appendix hereto). In the simplest instance, the effective transverse wavenumber is determined approximately by the expression:

$$p=2\pi\sqrt{\epsilon_{eff}}/\lambda_o$$

where $\epsilon_{eff}$ is the effective dielectric constant of the overall arrangement and the $\lambda_o$ is the free space wavelength, which is about 12.236 cm at the standard microwave oven operating frequency of 2.45 Ghz. This expression is obtained from the more general expression:

$$p^2-\gamma^2=\omega^2\mu\epsilon$$

where $\gamma$ is the penetration axis propagation factor, $\omega$ is the angular frequency, $\mu$ is the magnetic permeability and $\epsilon$ is the electric permittivity of the load, following separation of variables in Maxwell's equation and assumption of orthogonality in the vertical axis. Since $\lambda_o$ is expressed in cm, p is expressed in units of $cm^{-1}$. $\epsilon_{eff}$ is approximated by the Galejis expression:

$$\epsilon_{eff}=\tfrac{1}{2}(\epsilon_{load}+\epsilon_{ext})$$

where $\epsilon_{load}$ is the dielectric constant of the load and $\epsilon_{ext}$ is the dielectric constant of the surroundings of the active element. In the case of an exposed surface of a load or of a wave of a minimally reflective container enclosing it, $\epsilon_{ext}$ has a value of nearly unity.

However, if the container enclosing the load is supported by a glass tray, for example, the value of $\epsilon_{ext}$ takes on a value approaching the relative dielectric constant of the glass container, which is typically about 5. With an intervening air gap between the active element and the load, $\epsilon_{eff}$ will have a lower value than provided by the Galejis approximation and this, in turn, will be lower than $\epsilon_{load}$.

For an active element located on or near an exposed surface of the load, the overall range is determined by the expression:

$$\epsilon_{load}>\epsilon_{eff}>1$$

and, with the approximation $$\epsilon_{surf}=\tfrac{1}{2}(\epsilon_{load}+1)$$

where $\epsilon_{surf}$ is the dielectric constant at the exposed surface, a narrower range can be defined:

$$\epsilon_{surf}\geqq\epsilon_{eff}>1$$

The first resonant dimension of an active element provided herein depends on the geometric shape of the element. For a strip or slot, this dimension is determined by the length of the strip or slot, for a loop or annular slot, by the intermediate circumference and for a patch or aperture, by the bounding circumference.

The corresponding transverse wavenumber for the first resonant dimension is given by the expression:

$$p=\pi n/s$$

where n is the mode order of the microwave radiation and s is the length or circumferential dimension. From the above derivation of the transverse wavenumber, it follows that the resonant dimensions are determined from the expression $$s=n\lambda_o/2\sqrt{\epsilon_{eff}}$$

Dipole type strip or slot lengths are provided by the above expression with n $\epsilon$ $I^+$. In the case of mono-type strips and slots, the slot length is determined by the expression:

$$s=(2k+1)\lambda_o/4\sqrt{\epsilon_{eff}}$$

with k being 0, 1, 2 . . . etc. but the current paths are multiples of $\lambda_o/2\sqrt{\epsilon_{eff}}$.

strip and slot monopole and dipole lengths are subject to correction for end-effects and width. The relationship of decreasing resonant lengths with increasing width can be roughly expressed as:

$$s=n\lambda_o/2\sqrt{\epsilon_{eff}}-\omega$$

where $\omega$ is the corresponding width.

For closed structures, such as loops, annular slots, patches and apertures, resonance and anti-resonance occur at even and odd integral values of n, respectively. While the propagation of microwaves is closely guided by loop and annular elements, a large number of resonances are supported over patch and aperture cross-reactions. Consequently, past a first circumferential resonance determined by the equation $$s=n\lambda_o/2\sqrt{\epsilon_{eff}}$$

subsequent resonances and anti-resonances are obscured by two-dimensional structures unless those active elements are combined with other active elements that either reinforce the circumferential resonances or restrict the other modes.

A more rigorous description of loops and annular slots requires analysis of the transverse solutions for the corresponding coaxial coordinate systems. The transverse wavenumber first appears in separating out the vertical part of the solutions and then provide a useful description of the more complex two-dimensional resonance occurring in wider elements and in patches and apertures. Two resonances corresponding to distinct element geometries but with the same transverse wavenumbers have identical vertical dependencies.

The transverse wavenumbers for simple geometrical shapes of active element may be summarized in the following manner:

1. RECTANGULAR PATCH OR APERTURE:

We take a as the length, b the width, and m and n as describing the corresponding mode order. When m or n is zero, we obtain the strip or slot definition p=πn/s given above.

$$p=\pi(m^2/a^2+n^2/b^2)^{1/2}$$

2. CIRCULAR PATCH OR APERTURE:

The description for patch elements resembles the $TM_{n,m}$ cavity one used for resonant microstrip patches (see for example, J. R. James and P. S. Hall, "Handbook or Microstrip Antennas", v.2, Peter Peregrinus, 1989, pp. 1202–8). Here, $j'_{n,m}$ are the zeros of the derivative of the Bessel function of order n, and m and n describe the radial and angular mode orders, respectively. We take a as the patch or aperture radius.

$p = j'_{n,m}/a$
Zeros of $j'_n(pa)$

| | n | | | |
|---|---|---|---|---|
| m | 0 | 1 | 2 | 3 |
| 1 | 3.8317 | 1.8412 | 3.0542 | 4.2012 |
| 2 | 7.0156 | 5.3314 | 6.7061 | 8.0152 |
| 3 | 10.1735 | 8.5363 | 9.9695 | 11.3459 |

3. CIRCULAR RING OR SLOT:

With a the inner radius, b the outer radius and n the mode order, the following approximate relationship is obtained:

$$p=2n/(a+b)$$

4. ELLIPTICAL PATCH OR APERTURE:

We take a and b as the half major and minor axis dimensions, respectively, and eccentricity e is $(a^2-b^2)^{1/2}/a$. The parameter q is obtained with some difficulty following the calculations of J. G. Kretzschmar, "Wave Propagation in Hollow Conducting Elliptical Waveguides", IEEE Transactions on Microwave Theory and Techniques, Vol. MTT-18 1970, pp. 547–554.

$p = 2\sqrt{q}/ae$

| Mode | Expression for q | Range of e |
|---|---|---|
| $TM_{C11}$ | $q = -0.847e^2 - 0.0013e^3 + 0.0379e^4$ | 0.0–0.4 |
| | $q = -0.0064e + 0.8838e^2 - 0.0696e^3 + .082e^4$ | 0.4–1.0 |
| $TM_{a11}$ | $q = -0.0018e + 0.8974e^2 - 0.3679e^3 + 1.612e^4$ | 0.05–0.50 |
| | $q = -0.1483 - 1.0821e - 1.0829e^2 + 0.3493/(1 - e)$ | 0.50–0.95 |
| $TM_{c21}$ | $q = 0.0001e + 2.326e^2 + 0.0655e^3 - 0.981e^4$ | 0.0–0.42 |
| | $q = -.006e + 2.149e^2 + 0.9476e^3 - 0.0532e^4$ | 0.42–1.0 |
| $ATM_{a21}$ | $q = -.0053e + 2.470e^2 - 0.9098e^3 + 2.8655e^4$ | 0.05–0.60 |
| | $q = 1.0692 - 5.2863e + 5.9122e^2 + 0.4171/(1 - e)$ | 0.60–0.95 |

For small values of e, an equivalent radius approximation may be used to provide the relationship:

$$p=j'_{n,m}/a(1-e)^{1/4}$$

5. EQUILATERAL TRIANGULAR PATCH OR APERTURE:

With a the side dimension, and m and n describing the mode order $$p=4\pi(m^2+mn+n^2)^{1/2}/3a$$

6. HEXAGONAL PATCH OR APERTURE:

This element is approximately described using an equivalent radius obtained by comparison of circular and hexagonal areas. Using a to denote the sides of the hexagon, we get:

$$p=j'_{n,m}/a(3\sqrt{3}/2\pi)^{1/2}$$

One key feature of the active elements provided herein is their responsiveness to the dielectric properties and interference effects of an adjacent food or other microwave heatable load, causing the elements to shift site or pass through substantially resonance or anti-resonance during the microwave heating cycle. When resonant, the intense fields generated promote heating of the foodstuff while when enervescent, the active elements suppress heating, permitting modification of heating distributions and power absorption. Selective heating results from differential variations of power absorption between a plurality of the structures or between one or more of the structures and regions of a food that are either open or shielded. Browning and crispening result from the intense electric fields obtained at resonance.

As noted earlier, the active elements may take the form of one or a plurality of strips, slots, open or closed loops, apertures or patches, or circuits formed from strips connected to loops or patches, as well as inverted analogs of a sheet with one or a plurality of slots, annular slots or circuits formed of slots connecting annular slots or apertures. These structures may be combined with strip-like structures being used to feed slot-like structures and vice-versa.

The resonant or anti-resonant properties of the strip, slot and loop active elements provided herein when adjacent to a food change significantly over the heating cycle, as a result of changes in the state, temperature and/or composition of the foodstuff. This sensitivity permits the active elements to be self-limiting or "smart" in their heating, by turning "on" or "off" in response to changes in the food. The interaction of the active elements with interferences within the foodstuff allows heating maxima to be displaced in the vertical axis. This property is particularly useful in frozen foods, allowing mid-depth minimum accompanying destructive interferences in thick items to be replaced by a maximum.

Another useful property of the active elements is their sensitivity to the presence of packaging or microwave oven components. Scorching of active microwave components is commonly a problem when such components are mounted on paperboard trays. However, the active elements provided herein may be tuned to be anti-resonant and hence non-scorching in the absence of foodstuff.

A practical design of a packaging structure for a particular foodstuff utilizing the principles described herein may comprise locating cold spots for a particular package cross section and the determining strip or loop resonant lengths in the adjacent regions. These lengths then are adjusted for the presence of air gaps or intervening packaging material and the resonant structures positioned at the cold spots. If the goal were predominantly one of modifying energy deposition in a frozen food, then standardized strip and loop designs may be provided for a variety of cross sections, with suitable ready modification for non-standard loads. The addition of parasitic structure would allow some browning and crispening effects. By selecting lengths that are anti-resonant in the absence of food, scorching can be avoided.

In their various combinations, the active elements provided herein may be applied to or enclosed within the surfaces of a variety of disposable or permanent supports, including sheets, trays, pans, covers, stands, boxes, plastic cans, tubes, pouches or flexible wrapping. When applied to such supports, the active elements may be used to modify heating distributions in adjacent food or other microwave heatable load, for control of power absorption, for selective heating in multi-component meals, for browning and crispening, or combinations of these functionalities, by suitable application of the principles described above. In some instances, the structures may be employed to modify the heating properties of supporting structures that are lossy.

The active elements provided herein need not be precisely rectilinear or circular to be effective structures but rather the elements may assume a wide variety of geometries, including rectangular, polygonal, circular, elliptical, trochodial or flattened cross sections. The elements may be employed herein as arrays in one or a combination of sizes and may enclose other structures, such as metal or suscepting islands, or may be enclosed within apertures or rings. The active elements provided herein usually are planar but non-planar structures are possible.

The use of resonant and anti-resonant structures as well as shielding may be incorporated into a single microwave packaging structure. One example of such combined structure is a frozen TV dinner, which may comprise a meat component, a vegetable component and a dessert component, each requiring a different degree of heating to be provided at the desired temperature for consumption. The heating of the meat component may be intensified by the use of a resonant ring structure in the cover of the TV Dinner tray above the compartment containing the meat component while the intensity of heating of the vegetable is attenuated by the use of an anti-resonant ring structure in the cover of the TV Dinner tray above the compartment containing the vegetable component. An anti-resonant ring structure also may be provided in association with the meat compartment, which may also contain a potato serving, to attenuate heating of peripheral portions of the meat component. An aluminum foil shield may be provided in the cover over the compartment containing the dessert component to minimize exposure to microwave radiation. In this way, the food in the different compartments is subjected to differential degrees of heating by the microwave energy to attain an overall uniformly reconstituted product for consumption.

The active microwave heating elements provided herein may be constructed of electroconductive or semi-conductive material which define strips and/or loops or in which elongate and/or annular slots are formed. Such electroconductive or semi-conductive material may be any electroconductive or semi-conductive material, such as a metal foil, vacuum deposited metal or metallic ink. The metal conveniently is provided by aluminum, although other electroconductive metals, such as copper, may be employed. In addition, electroconductive metals may be replaced by suitable electroconductive or semi-conductive or non-conductive artificial dielectrics, ferroelectrics, ferri- or ferromagnetics, lossy substances (in an ohmic, dielectric or magnetic sense), contiguous regions of relatively thick or thin dielectrics, magnetic or lossy substances, and contiguous regions of relatively high or low dielectric constant, magnetic permeability or lossiness.

Artificial dielectrics comprise conductive subdivided material in a polymeric or other suitable matrix or binder, and may comprise flakes of electroconductive metal, such as aluminum. At very low filler volume fractions, the dielectric constant of these coatings is essentially that of the binder. However, as volume fractions approach 15 per cent, the dielectric constant of the coating increases, and at high loadings, can approach values exceeding about 1000. Such high values are due both to the high form factors of flakes (i.e. as compared to spherules) and leafing action of the filler caused by surface tension effects, whereby the flakes align to a stacked lamellar structure, resembling that of many small capacitors. The dielectric constant ($\epsilon$) of the artificial dielectric can be determined by the relationship (Bruggeman's equation):

$$\epsilon=\epsilon_m/(1-fV)^3$$

where V is the volume fraction of metal flakes and f is the form factor attributable to the flakes.

Reflection at artificial dielectric boundaries provides an analogous effect to shielding by metal foil areas. The reflective properties of foil are attributable to the disappearance of E-field components tangential to its surfaces. These components are instead continuous across the boundaries of an artificial dielectric material, but on penetrating the material, the normal E-field component is required to decrease inversely by the ratio of its dielectric constant to that of the surroundings. For high dielectric constants, this normal component becomes proportionately small, leading to the PMC wall approximation and vertical functions that are in quadrature with their PEC counterparts. This field quadrature is seen by comparing the field distributions seen in FIGS. 1 to 12 and 21 to 32. An important distinction over foil is that artificial dielectric losses below percolation are small, allowing transmission through appreciable thicknesses of such materials. Even at very high dielectric constants, this effect reduces their effectiveness as shields. However, the partial reflection occurring at artificial dielectric boundaries allows a variety of vertical interference effects to be achieved. The combination of transmissiveness with reflective boundaries of the artificial dielectric materials permits the microwave guidance described herein, resembling the total internal reflection of dielectric waveguide or optical fibre.

When metal foil is employed to provide the structures provided herein, such material may have any convenient thickness, generally ranging from about 1 to about 150 microns. When vacuum deposited metal is employed, the thickness of the metal may be any convenient thickness, generally ranging from about 0.005 to about 15 microns.

In the packaging structure, the electroconductive or semi-conductive material defining the active element generally is provided on a substrate formed of dielectric material, which may be a rigid or flexible polymeric film, a cellulosic material layer, such as paper or paperboard, or combinations of such materials. Depending on the nature of the substrate, the electroconductive or semi-conductive material may be adhered to the substrate through an adhesive layer. In the case of flexible polymeric film, vacuum deposition may directly adhere the electroconductive or semi-conductive material to the substrate.

The laminate structure from which the packaging material is formed may comprise additional layers adhered to one or both sides thereof to provide desired packaging properties consistent with the intended end use. Such additional layers may include layers imparting chemical barriers, graphics, stiffness, sealability and releasibility.

The packaging structures provided herein may be provided in a variety of forms, depending on the foodstuff to be packaged or the nature of the microwave heatable load. For example, the packaging structure may be in the form of a bag or sleeve, a box or folding carton, a window in a carton, a tray, a dish or lidding material for a tray or dish.

The desired pattern of material providing the strips, slots, loops or annular slots, and combinations thereof, may be provided in any convenient manner. When the conductive or semi-conductive material comprises an etchable metal, the desired pattern may be provided by selective demetallization, as described, for example, in U.S. Pat. Nos. 4,398,994, 4,610,755 and 5,340,436, assigned to the assignee hereof and the disclosures of which are incorporated herein by reference.

Alternative procedures may be employed to provide the desired pattern, including die cutting or laser cutting, or by application, such as by printing in the case of the electroconductive or semi-conductive material being applied in the form of an ink.

DESCRIPTION OF ILLUSTRATED EMBODIMENTS

Referring now to FIGS. 1 to 32, FIGS. 1 to 6 illustrate simple slot and strip structures. In the various illustrations, $|E|^2$ refers to the squared magnitude of the electric fields. In FIG. 1, the fields are directed normally from the tip of the monopole strip and intersect normally with the bulk regions on either side of it. Since the direction is the same, the polarity at the back is the same. This has the effect of causing the fields to vary as sine functions of the same sign with distance from the stub, forcing a phase shift of 180° in closed structures.

Figure 2:
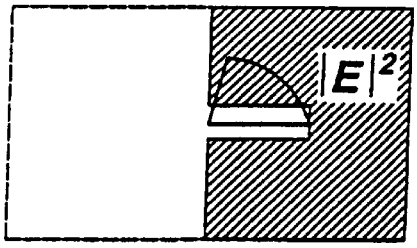
FIG. 2 shows another shape of an active element of the strip and slot type which may be used in the formation of microwave packaging structures in accordance with the invention.

In FIG. 2, the polarity of the E-fields is opposite across the slot. This causes the fields in the adjoining bulk to vary as cosine functions of opposite sign with distance from the slot, and again forces a 180° phase shift in closed structures. In extracting the first rules of combination, we see that when the precursors are joined at a zero of the E-fields, the fields continue with the opposite sign in the adjoining regions. When combined at a maximum, the fields continue with the same sign.

Figure 3:
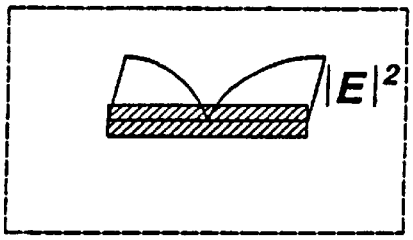
FIG. 3 shows another shape of an active element of the strip and slot type which may be used in the formation of microwave packaging structures in accordance with the invention.
Figure 4:
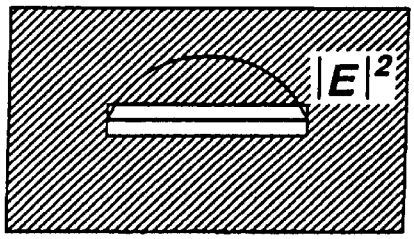
FIG. 4 shows another shape of an active element of the strip and slot type which may be used in the formation of microwave packaging structures in accordance with the invention.
Figure 5:
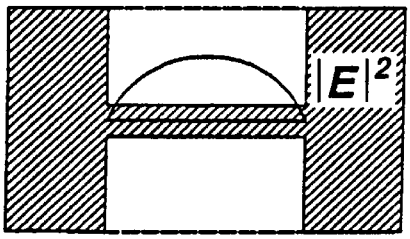
FIG. 5 shows another shape of an active element of the strip and slot type which may be used in the formation of microwave packaging structures in accordance with the invention.
Figure 6:
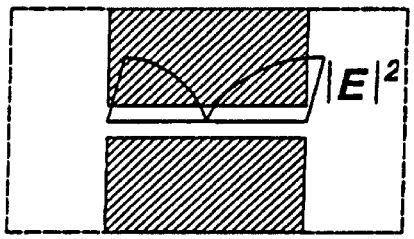
FIG. 6 shows another shape of an active element of the strip and slot type which may be used in the formation of microwave packaging structures in accordance with the invention.

In FIGS. 3 to 6, strips and slots of two different types are provided, in one case, FIGS. 3 and 4, the strip or slot being close-ended while, in the other case, FIGS. 5 and 6, the strip or slot are open ended. The opposite energy distribution provided in the two sets of structures is apparent from the illustration.

Figure 7:
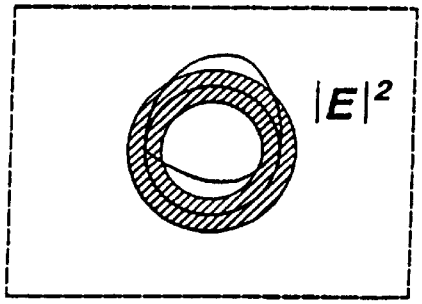
FIG. 7 shows another shape of an active element of the strip and slot type which may be used in the formation of microwave packaging structures in accordance with the invention.
Figure 8:
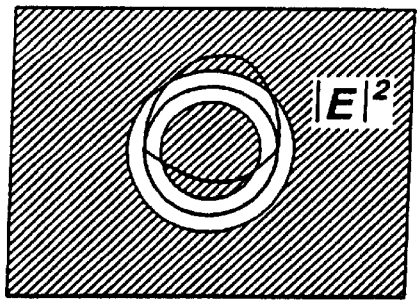
FIG. 8 shows another shape of an active element of the strip and slot type which may be used in the formation of microwave packaging structures in accordance with the invention.

FIG. 7 and 8 show circular closed and open loops. For resonance, the circumferential dimension may be a wavelength multiple. The ring structures of FIGS. 7 and 8 may be combined with one or more of the slot strip structures of FIGS. 1 to 6. With slots or strips, the angular orientation of the E-fields is fixed to give maximum, with opposite polarities on either side, or a minimum, respectively. Phase shifts of nearly 180° are induced for each closely coupled slot or link, so that resonances of a $\lambda_{eff}$ ring are suppressed for a single slot or link and a $3\lambda_{eff}/2$ ring shifts into resonance.

Figure 9:
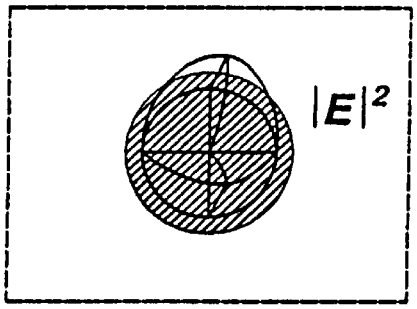
FIG. 9 shows another shape of an active element of the strip and slot type which may be used in the formation of microwave packaging structures in accordance with the invention.
Figure 10:
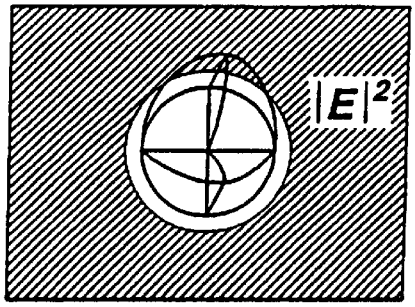
FIG. 10 shows another shape of an active element of the strip and slot type which may be used in the formation of microwave packaging structures in accordance with the invention.
Figure 11:
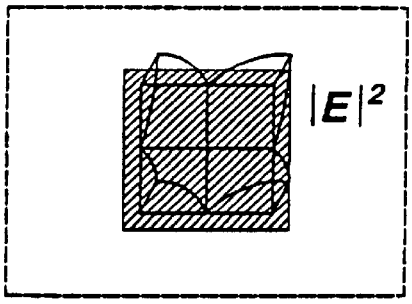
FIG. 11 shows another shape of an active element of the strip and slot type which may be used in the formation of microwave packaging structures in accordance with the invention.
Figure 12:
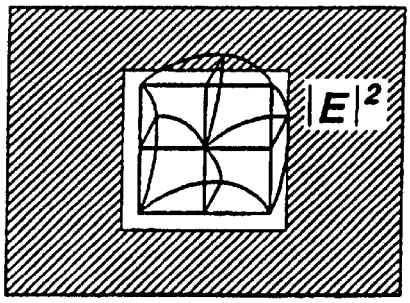
FIG. 12 shows another shape of an active element of the strip and slot type which may be used in the formation of microwave packaging structures in accordance with the invention.

FIGS. 9 to 12 illustrate patches and apertures, which may be coupled with other elements. In the case of FIGS. 9 and 10 the patch or aperture is circular while, in the case of FIGS. 11 and 12, the patch or aperture is square. Phase shifts in combining these elements with the structures of FIGS. 1 to 6 follow similar rules to those discussed above. Two-dimensional resonances are more complicated, but for curved aperture shapes defined by metallic boundaries, we can apply $\partial R_z(u,v)\partial u=0$ to finding p values.

Figure 13:
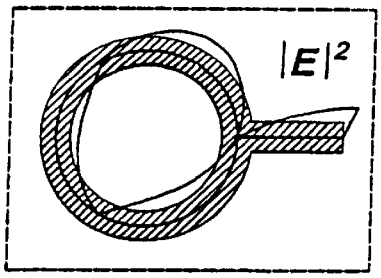
FIG. 13 shows another shape of an active element of the strip and slot type which may be used in the formation of microwave packaging structures in accordance with the invention.
Figure 14:
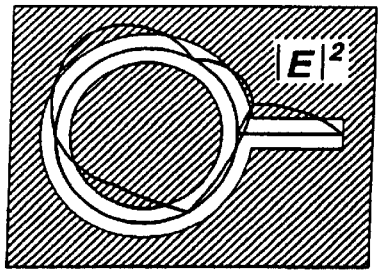
FIG. 14 shows another shape of an active element of the strip and slot type which may be used in the formation of microwave packaging structures in accordance with the invention.
Figure 15:
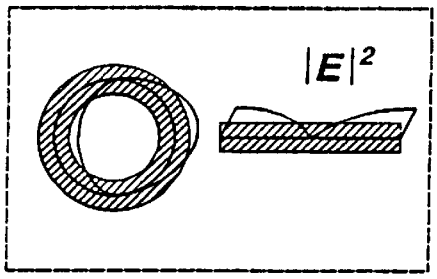
FIG. 15 shows another shape of an active element of the strip and slot type which may be used in the formation of microwave packaging structures in accordance with the invention.

FIGS. 13 and 14 show combinations of the structures of FIGS. 7 and 8 and FIGS. 1 and 2. The switching of an otherwise anti-resonant ring into resonance, as can be seen by comparison with FIGS. 1 and 7 and FIGS. 2 and 8, provides a rather striking example of "conductive" coupling, following the combination rules discussed above.

Figure 16:
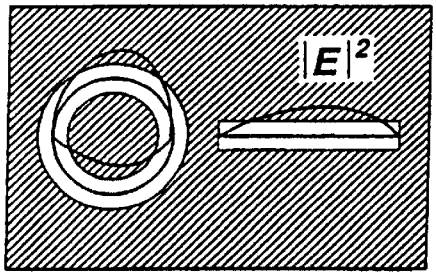
FIG. 16 shows another shape of an active element of the strip and slot type which may be used in the formation of microwave packaging structures in accordance with the invention.

FIGS. 15 to 20 are intended to illustrate various "capacitative" (i.e. electric) and inductive (i.e. magnetic) coupling schemes. The inductive scheme of FIG. 16 provides tighter coupling than in FIG. 15, which has an oven-dependent anti-resonant component. In FIG. 16, roughly half the currents coupled to the slot are forced through the separating region. The H-fields induced by these currents couple well with those of the slot elements.

Figure 17:
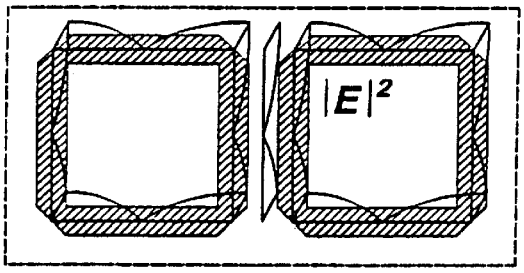
FIG. 17 shows another shape of an active element of the strip and slot type which may be used in the formation of microwave packaging structures in accordance with the invention.
Figure 18:
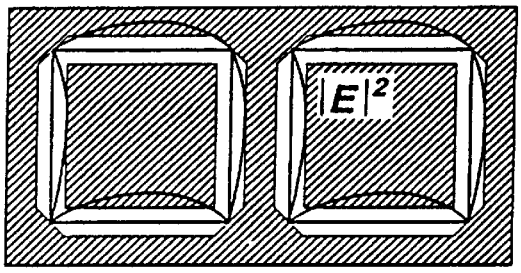
FIG. 18 shows another shape of an active element of the strip and slot type which may be used in the formation of microwave packaging structures in accordance with the invention.

The coupling of FIG. 17 is a precursor for array structures and is apparently stronger than in FIG. 18, because of cancellation and addition of currents in the connecting region. Cancellation of the current favours coupling of H-fields, but addition of the currents weakens this coupling. Similar "even" and "odd" current combinations affect the coupling of parallel linear slots.

Figure 19:
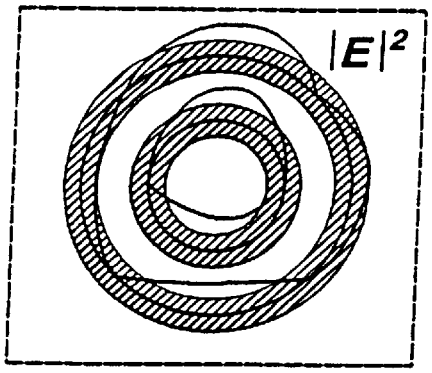
FIG. 19 shows another shape of an active element of the strip and slot type which may be used in the formation of microwave packaging structures in accordance with the invention.
Figure 20:
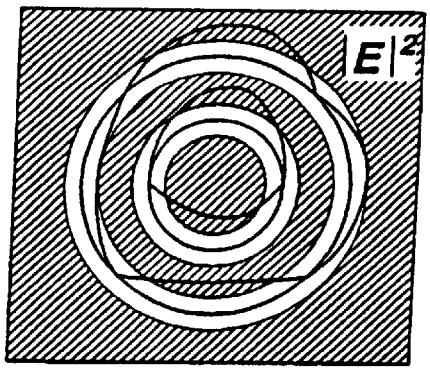
FIG. 20 shows another shape of an active element of the strip and slot type which may be used in the formation of microwave packaging structures in accordance with the invention.
Figure 21:
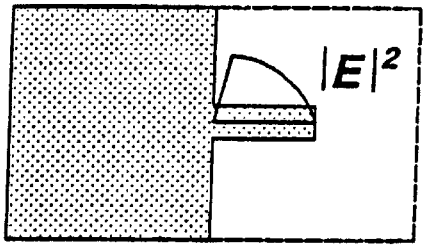
FIG. 21 shows a shape of active element of the strip and slot type which is formed from artificial dielectric material and which may be used in the formation of microwave packaging structures in accordance with the invention.
Figure 22:
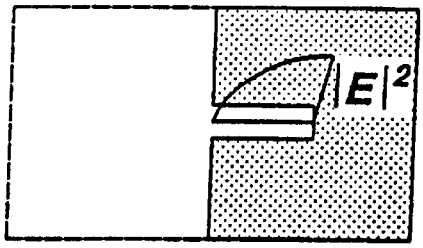
FIG. 22 shows another shape of active element formed from artificial dielectric material which may be used in the formation of microwave packaging structures in accordance with the invention.
Figure 23:
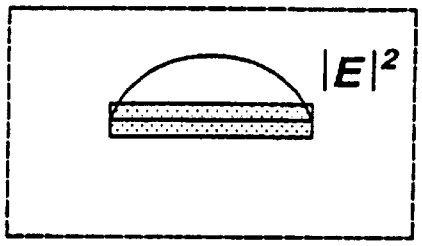
FIG. 23 shows another shape of active element formed from artificial dielectric material which may be used in the formation of microwave packaging structures in accordance with the invention.
Figure 24:
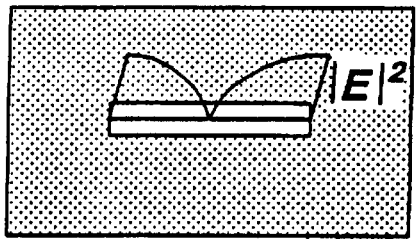
FIG. 24 shows another shape of active element formed from artificial dielectric material which may be used in the formation of microwave packaging structures in accordance with the invention.
Figure 25:
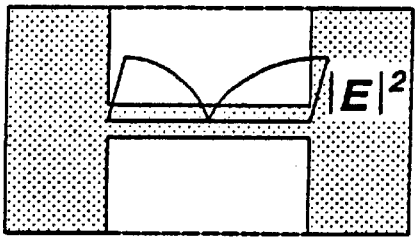
FIG. 25 shows another shape of active element formed from artificial dielectric material which may be used in the formation of microwave packaging structures in accordance with the invention.
Figure 26:
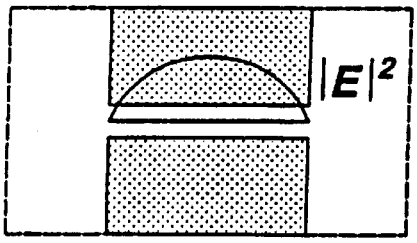
FIG. 26 shows another shape of active element formed from artificial dielectric material which may be used in the formation of microwave packaging structures in accordance with the invention.
Figure 27:
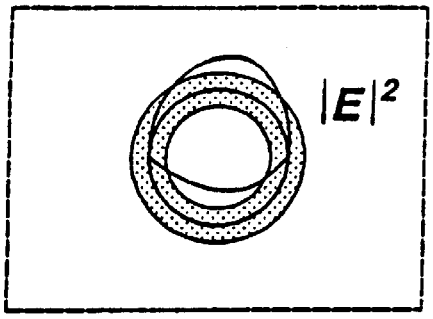
FIG. 27 shows another shape of active element formed from artificial dielectric material which may be used in the formation of microwave packaging structures in accordance with the invention.
Figure 28:
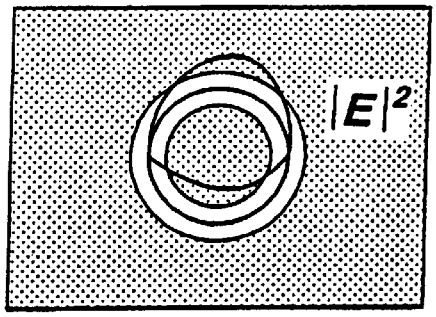
FIG. 28 shows another shape of active element formed from artificial dielectric material which may be used in the formation of microwave packaging structures in accordance with the invention.
Figure 29:
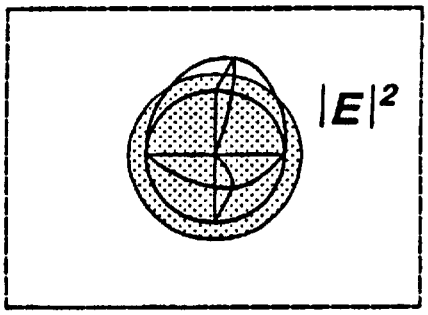
FIG. 29 shows another shape of active element formed from artificial dielectric material which may be used in the formation of microwave packaging structures in accordance with the invention.
Figure 30:
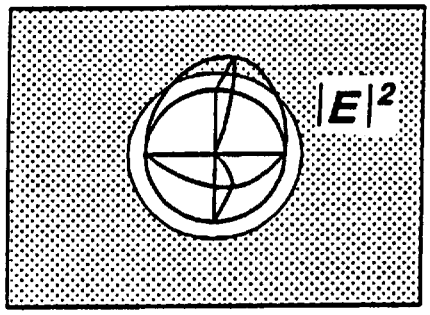
FIG. 30 shows another shape of active element formed from artificial dielectric material which may be used in the formation of microwave packaging structures in accordance with the invention.
Figure 31:
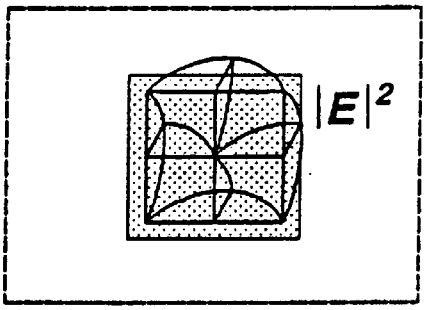
FIG. 31 shows another shape of active element formed from artificial dielectric material which may be used in the formation of microwave packaging structures in accordance with the invention.
Figure 32:
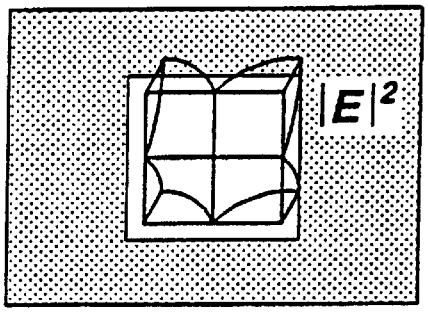
FIG. 32 shows another shape of active element formed from artificial dielectric material which may be used in the formation of microwave packaging structures in accordance with the invention.

FIGS. 19 and 20 show one of several internal coupling schemes. For compactness, the $\lambda_{eff}$, $2\lambda_{eff}$ scheme is shown. The positions of the maxima and minima can be fixed by the use of connecting links and slots, following principles described above with respect to FIGS. 2 and 8. It is also useful to note that the coupling fields can be described either by the use of coaxial coordinate solutions, or on a qualitative basis by trigonometric addition and subtraction of the individual element fields.

FIGS. 21 to 32 show the dielectric analogs of the electroconductive metal structures shown in FIGS. 1 to 12. There is a 90° shift, or quadrature, with respect to the field, in the linear strips and slots (FIGS. 21 to 26), but the symmetry of the shapes in FIGS. 27 to 32 does not fix the lobe positions. For curved aperture shapes, such as those of FIGS. 29 and 30, the values of p are found from $R_2(u,v)=0$, instead of $\partial R_2(u,v)/\partial u=0$.

Figure 33:
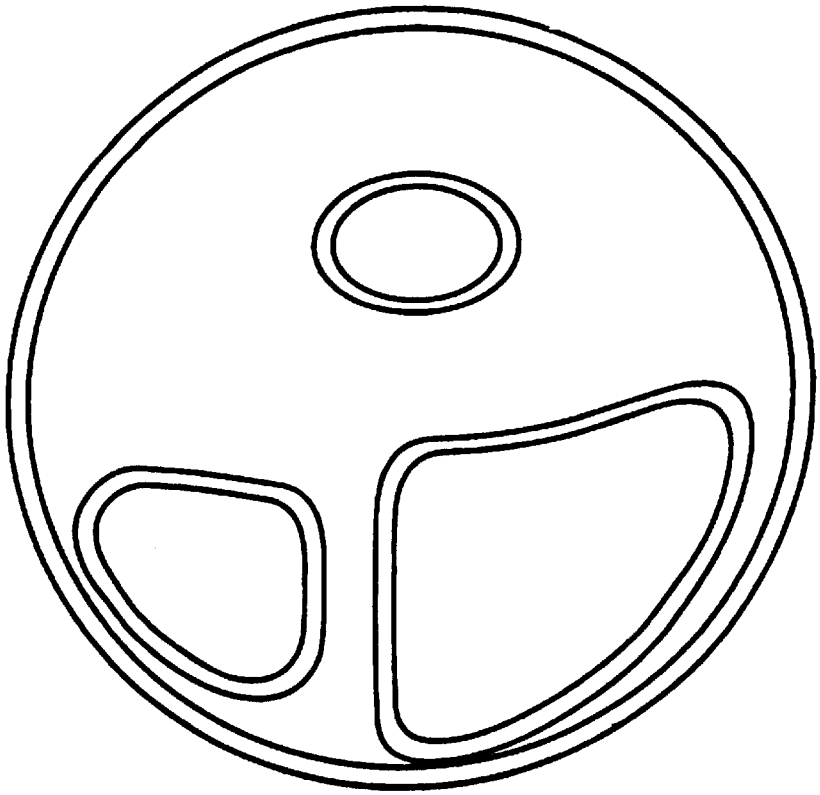
FIG. 33 is a full scale representation of a t.v. dinner tray having a transparent lid including loop elements provided in accordance with one embodiment of the invention.

FIG. 33 illustrates an embodiment of the invention as applied to frozen or TV Dinner tray. Such frozen dinners conventionally comprise a plurality of compartments, each receiving a different food component, but generally comprising a meat and potato serving, a vegetable serving and a dessert serving. In accordance with the present invention, the lid structure of the tray is modified so as to provide differential degrees of microwave energy heating to the food components. A resonant loop is provided over the meat and potato serving to intensify the microwave energy reaching the meat serving so as to intensely heat the central region of the meat, a traditional "cold spot". An anti-resonant loop is provided over the vegetable serving to attenuate the microwave energy reaching the vegetable serving. A microwave effective shield is provided over the dessert serving.

By employing the arrangement, a very satisfactory microwave reconstitution of the frozen food in the tray can be achieved, as seen by the illustrative Examples below.

Figure 34:
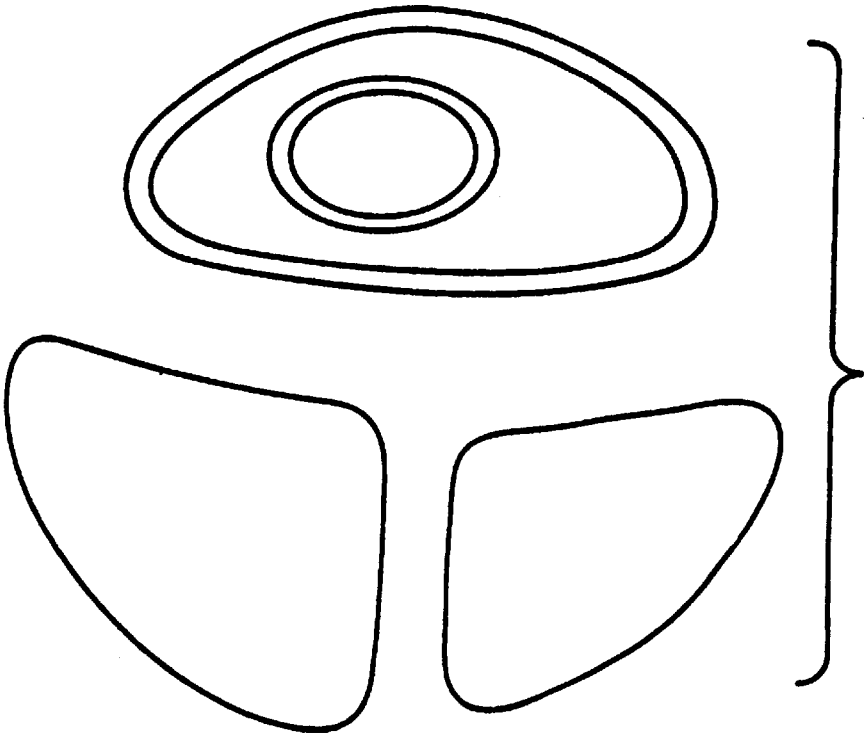
FIG. 34 is a full scale representation of a lid structure for a t.v. dinner tray including loop elements.
Figure 37A:
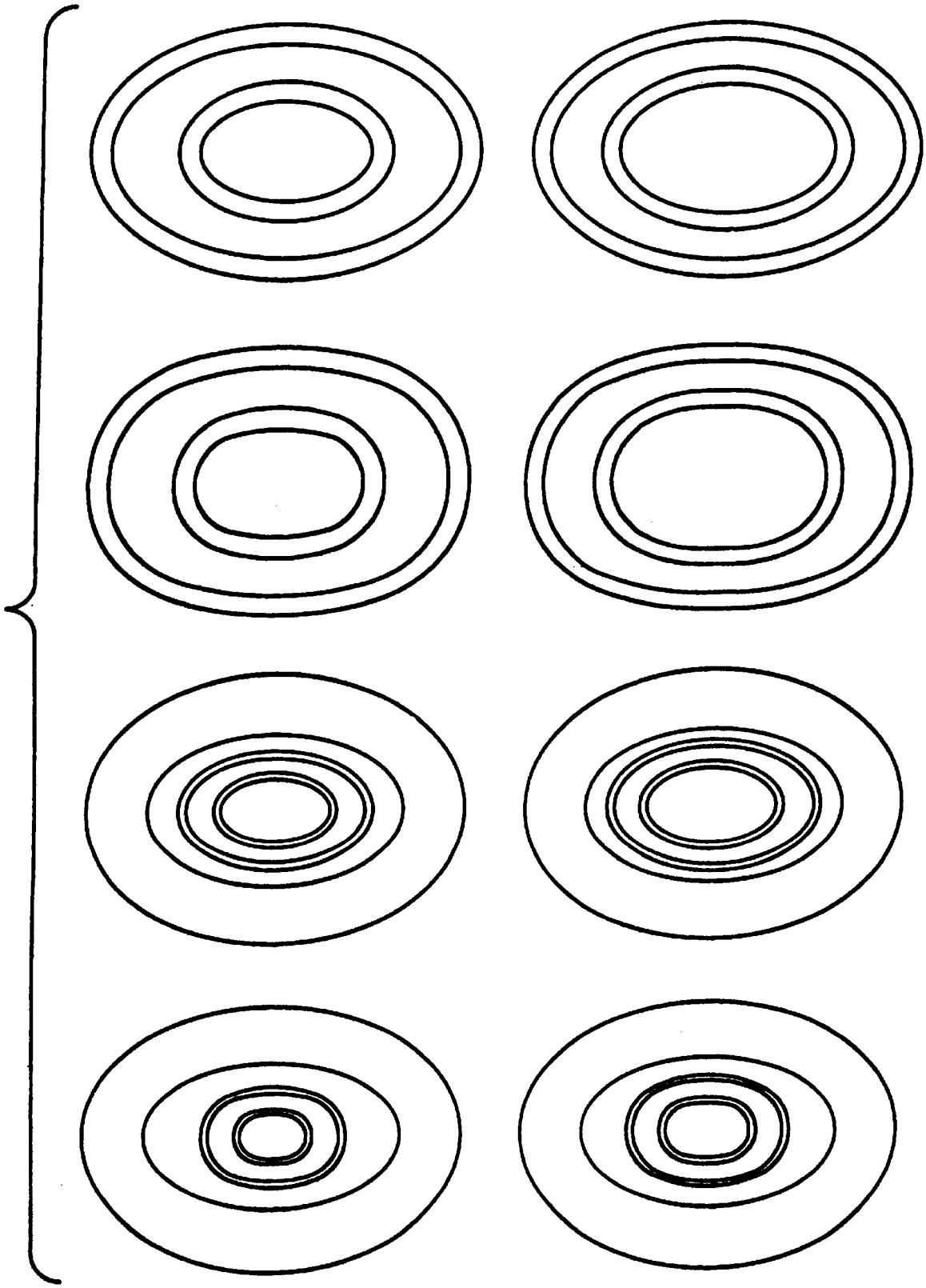
FIG. 37A contains four pairs of designs of oval loop elements provided in accordance with embodiments of the invention, with the left-hand member of each pair being resonant while the right-hand member of each pair is anti-resonant.
Figure 37B:
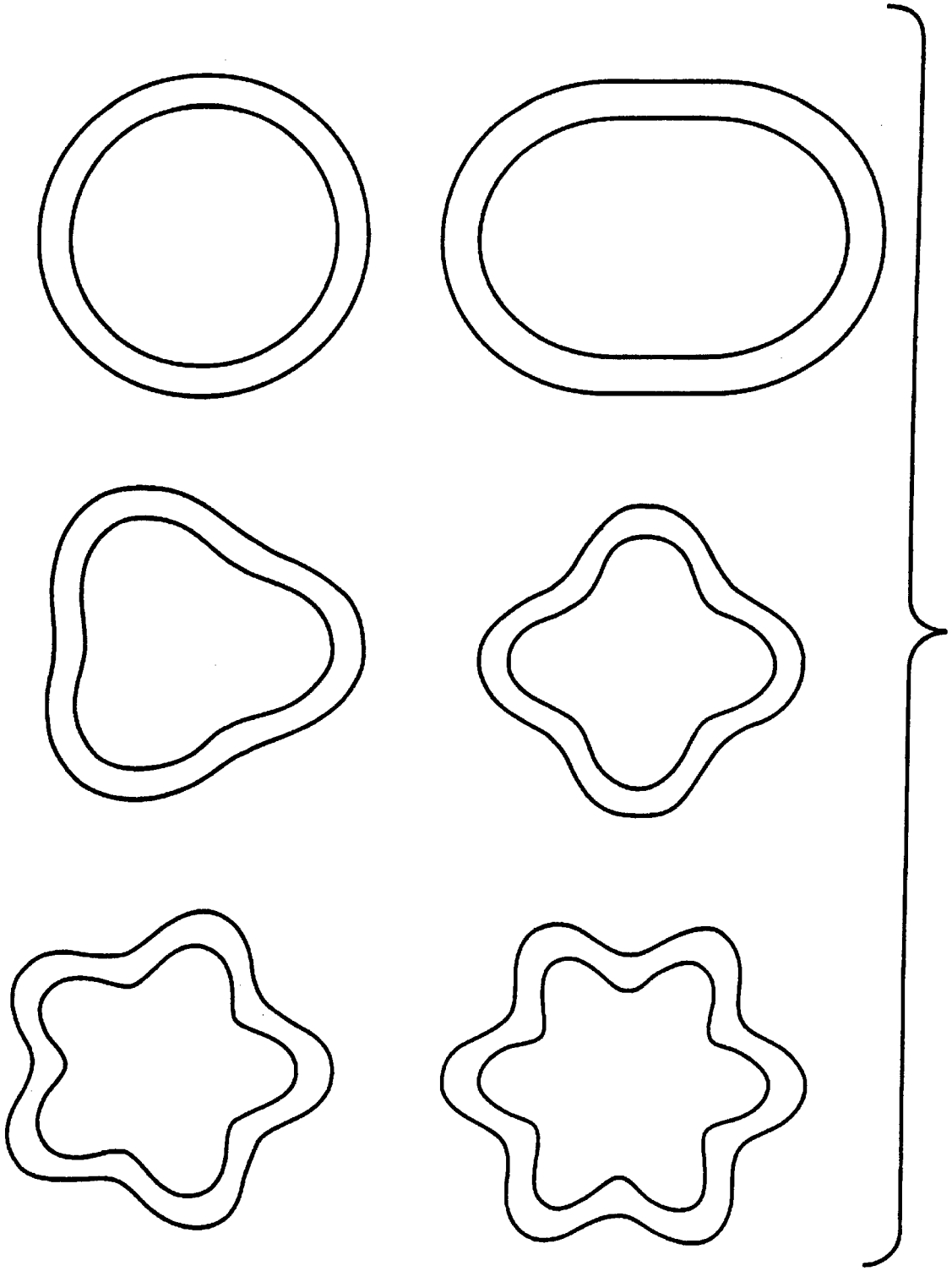
FIG. 37B contains three pairs of designs of trochoidal shape loop elements provided in accordance with embodiments of the invention, with the left-hand member of each pair being resonant while the right-hand member of each pair is anti-resonant.

FIG. 34 illustrates an alternative embodiment of the invention applied to a frozen dinner tray. In this instance, two microwave-reflective shields are provided while both a resonant and anti-resonant loop are employed. A variety of combinations of single and multiple resonant and anti-resonant loops may be provided in a variety of packaging structures, including lids and trays. A selection of such possibilities is shown in FIGS. 37A and 37B. In the last four structures in FIG. 37A, the resonant and anti-resonant loops are provided within an outer side wall comprising microwave effective metal.

EXAMPLES

The present invention is illustrated by the following Examples of specific embodiments thereof.

Example 1

This Example illustrates the problems inherent in reconstituting a frozen TV Dinner tray in a conventional oven.

A standard frozen dinner tray for a Salisbury steak dinner with a total weight of 371.3 g was cooked from frozen in a conventional convection oven following the manufacturer's directions at a temperature of 350° F., one sample for a cook time of 30 minutes and the other for a cook time of 40 minutes. At the end of the cook time, the tray was again weighed to determine moisture loss and the temperature was taken at various locations in the meat and potato, vegetable and dessert servings. The properties of the various foods were observed to determine edibility.

Figure 36A:
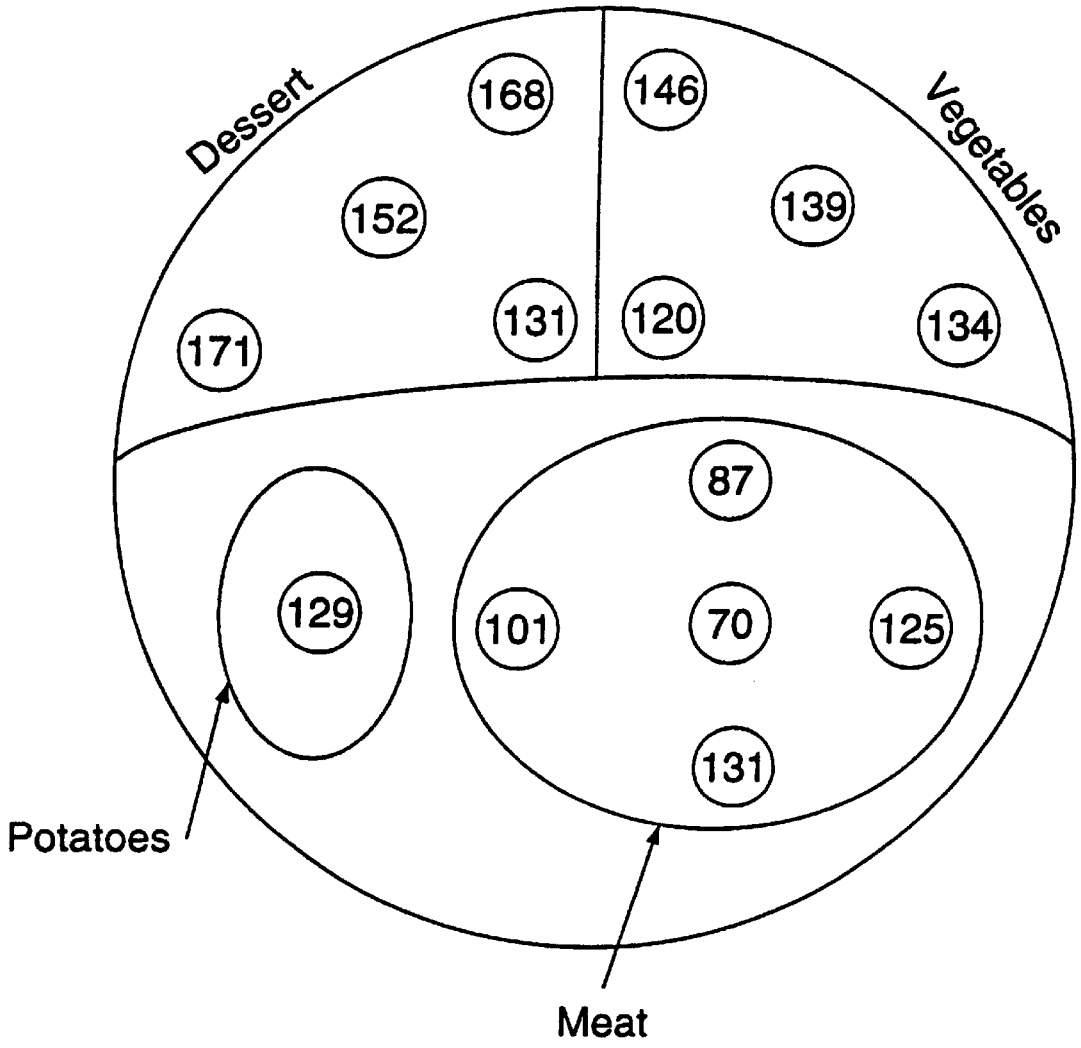
FIGS. 36A and FIG. 36B provide temperatures profiles at various location in a TV dinner tray cooked under conventional oven conditioned for two different time periods.
Figure 36B:
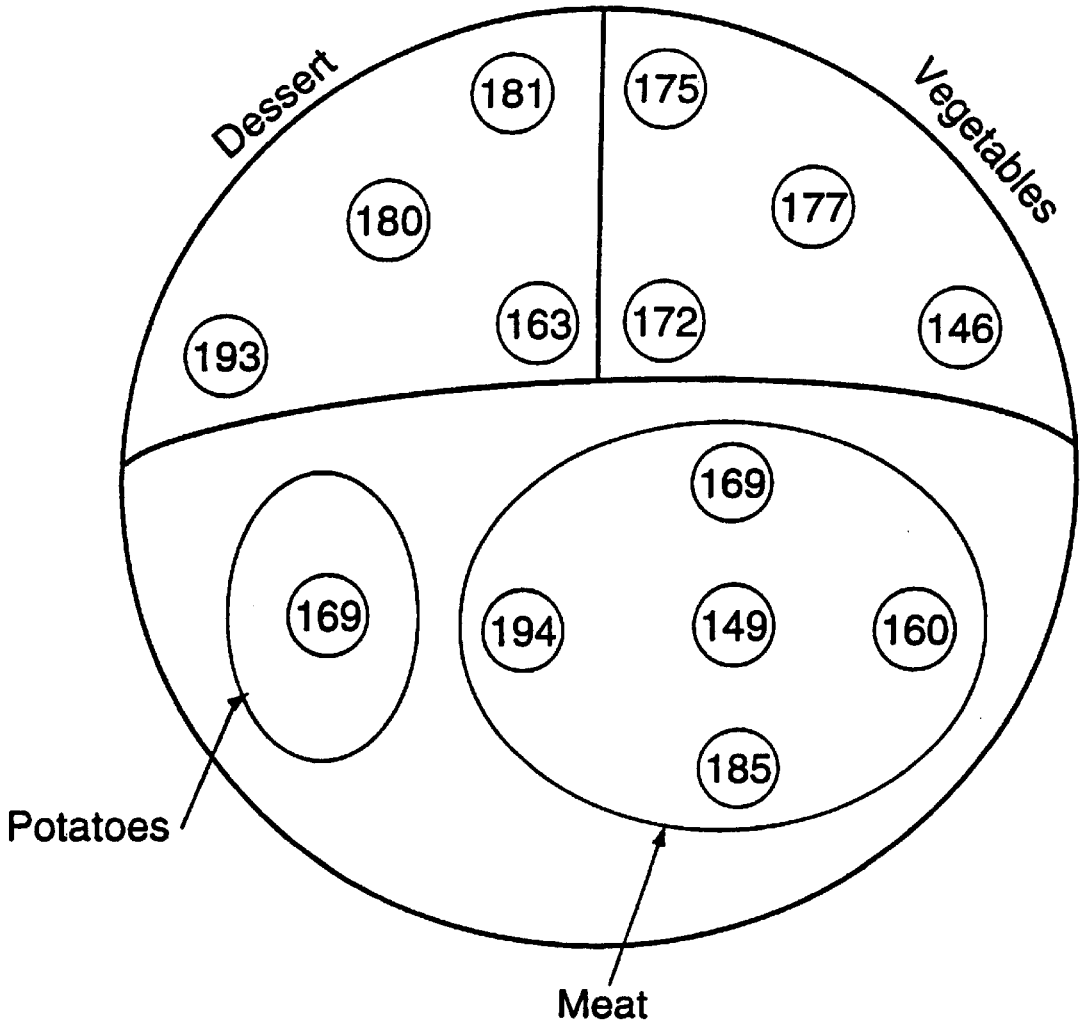

The results obtained are shown in FIG. 36A (30 minute cook time) and 36B (40 minutes cook time) and as well as in Table 1 below.

TABLE 1

Multi-Compartment meal fitted with a plain retail lid
Conventional oven, 350° F., 30 mins
(Temperature: ° F.)

| Trial Number | time (mins) | meat centre | meat overall | potato | dessert | vegetable |
|---|---|---|---|---|---|---|
| 1 | 30 | 70 | 111 | 129 | 155 | 135 |
| 2 | 40 | 149 | 177 | 169 | 179 | 168 |

As may be seen, the 30 minute cook time led to little moisture loss and acceptable edibility for the vegetable and dessert, but dry undercooked meat and hard, dry potatoes. Increasing the cook time resulted in a larger moisture loss, satisfactory moisture and temperatures for the meat and potatoes but dry and crisp vegetables and dessert.

Example 2

This Example illustrates the application of the principles of the present invention to a frozen TV dinner in a microwave oven.

A frozen TV dinner was housed in compartments as in the conventional oven arrangement described in Example 1. A number of independent sample experiments were conducted in which the frozen TV dinner was reconstituted from a frozen condition under full power of 6 minutes in a standard microwave oven (Sanyo-Kenmore 700W).

Figure 35A:
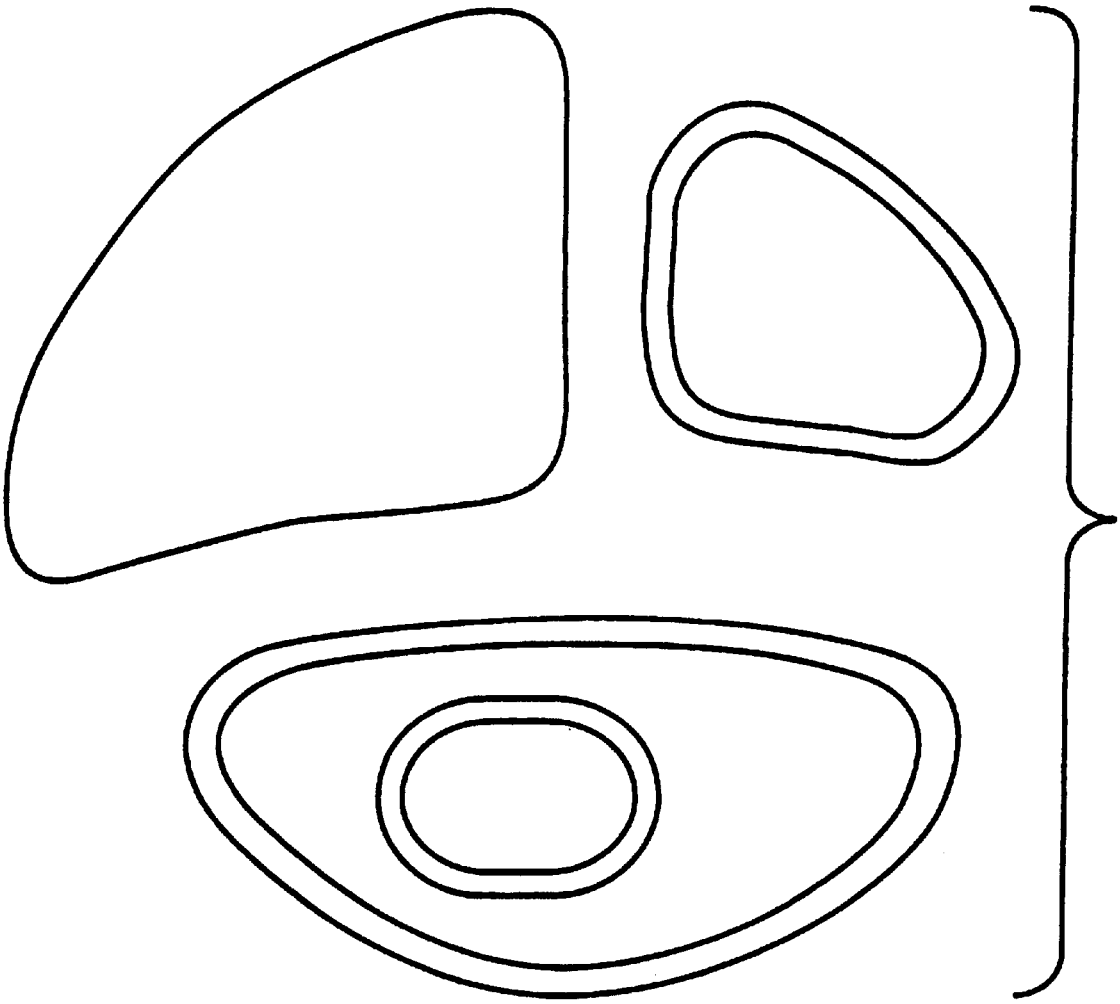
FIG. 35A is a scaled annotated representation of a lid structure for a TV dinner tray including loop elements provided in accordance with a further embodiment of the invention.
Figure 35B:
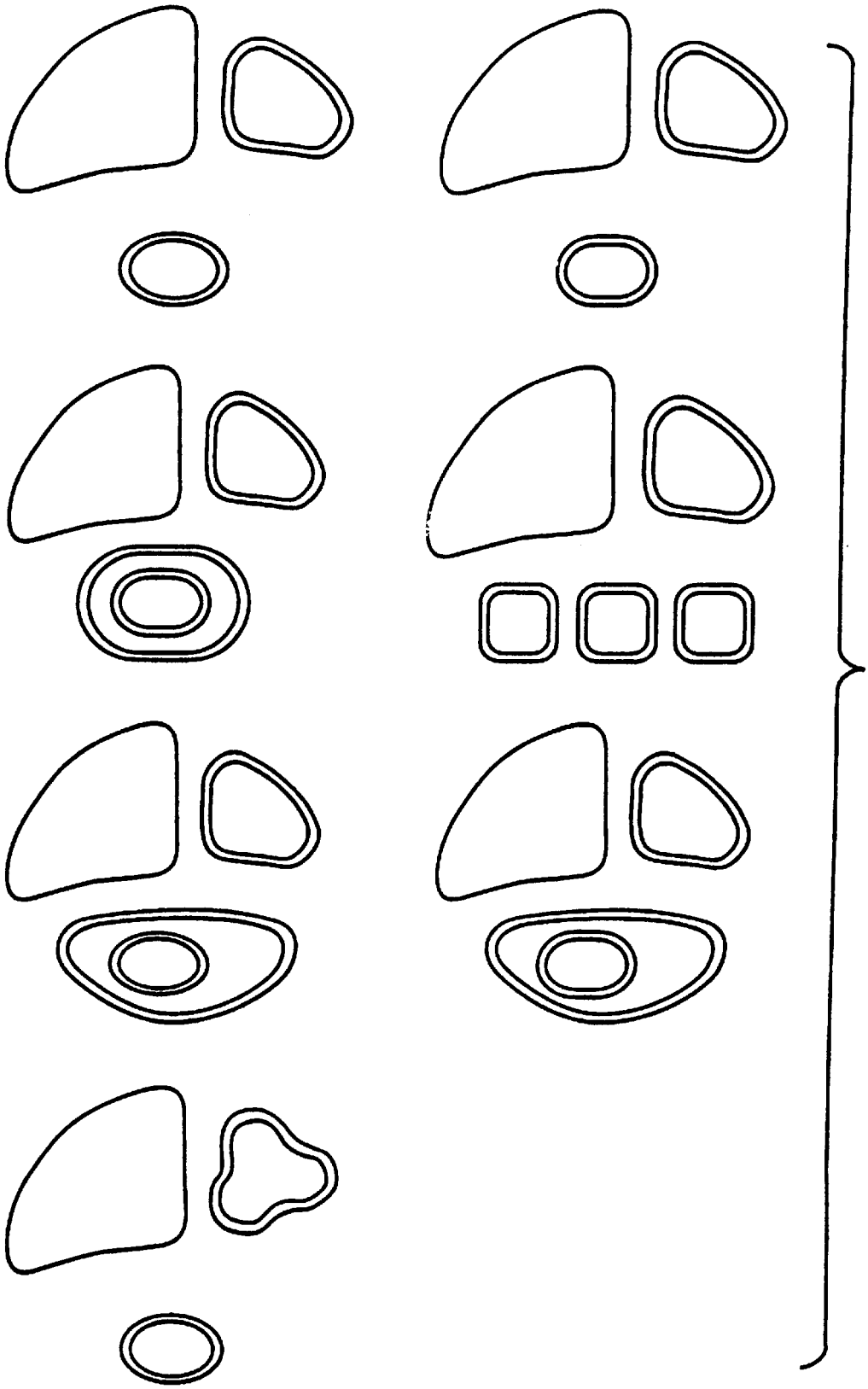
FIG. 35B contains a variety of modifications of the lid design shown in FIG. 35A for obtaining resonant and anti-resonant structures following the principles of the invention.

Two parallel sets of experiments were run, a first set using a lid bearing metal foil shielding and metal foil ring structures, having the dimensions shown in FIG. 35 and a second set using a plain microwave transparent lid. The results of the experiments are shown in Table 2 below. As seen from this Table, the microwave reconstitution with the plain lid led to the same sort of uneven heating of the various compartment of the TV dinner tray as in the case of conventional ovens.

However, using the lid of FIG. 35 lead to a much more uniform temperature in the food and, in particular, with the centre of the meat cooked to a desired degree.

Example 3

This Example illustrates the changes in food properties with changing state.

The meat patties from a frozen TV dinner were heated in a standard microwave oven and the temperature measured at half-minute intervals over time. In one case, a microwave transparent wrap was used while, in the other case, the wrap had a loop tuned (resonant) to the frozen condition of the patty adjacent the centre region of the patty. Two sets of experiments were performed and the results averaged. The results obtained are shown in Table 3 below.

Figure 38:
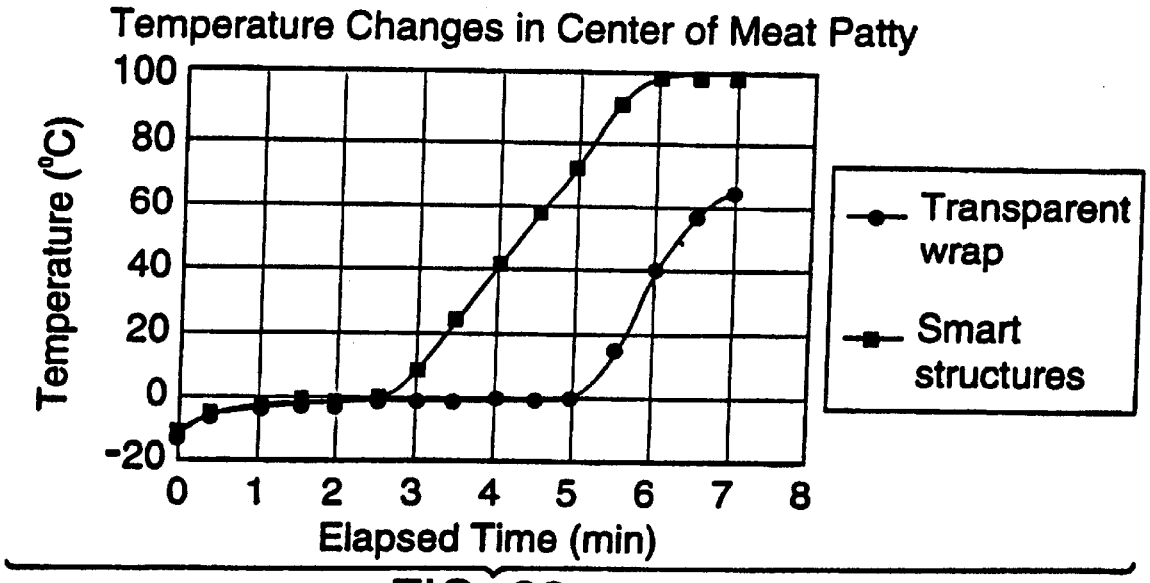
FIG. 38 is a graphical representation of the comparison of heating a frozen meat patty with and without the loop elements of the present invention.

The average values of the two sets of experiments were plotted graphically and shown in FIG. 38. As can be seen from this graph, the lid bearing the tuned (resonant) loop ("Smart structures") resulted in the centre of the meat patty being defrosted much more rapidly (about half the time) than the transparent wrapped patty, which enabled the centre of the meat patty to be much more rapidly heated and to attain a much higher temperature.

Example 4

This Example illustrates both resonant and anti-resonant behaviour in the same structure.

Circular aluminum foil loops were adhered to paperboard and placed on the glass tray of a conventional microwave oven (Sanyo-Kenmore 700W) and irradiated for 30 seconds. Proximity to the tray (dielectric constant of approximately 5) gave, through the Galejs approximation (see above), an effective dielectric constant of roughly 3, for an effective wavelength of nearly 7 cm at 2.45 GHz. Circular loops with circumferences (as the average of their inner and outer measurements) of single and double wavelength multiples, showed strong discoloration of the paperboard, with lobe placement characteristic of the corresponding resonances (i.e. two lobes at a displacement of 180 degrees for a 7 cm circumference). From this effective wavelength, anti-resonant behaviour was expected at a 1.5 wavelength multiple, and, in irradiating a loop of the corresponding circumference (10.5 cm), no discoloration was observed.

In placing 6 mm glass plates with a dielectric constant of approximately 5 over anti-resonant loop samples, a set of four discoloration lobes was observed, indicating a return of the previously anti-resonant structure to resonance. In this case, the effective wavelength is nearly 5.5 cm, and the loop circumference approaches the second harmonic resonant dimension of 11 cm.

Example 5

This Example illustrates the effect of modification of the geometry of a slotted structure according to the invention.

Figure 39A:
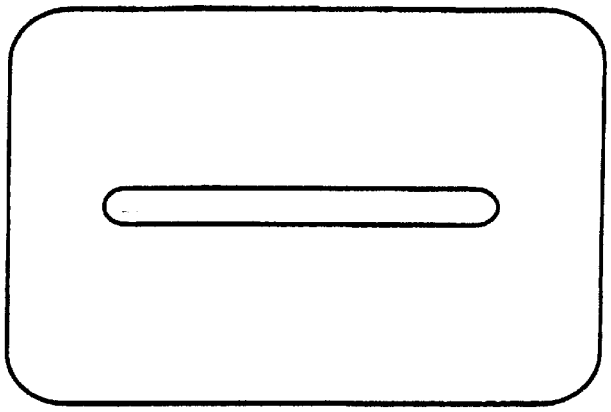
FIG. 39 shows two slot structures according to the invention, one with parallel sides and the other with pinched-in portions adjacent its ends.
Figure 39B:
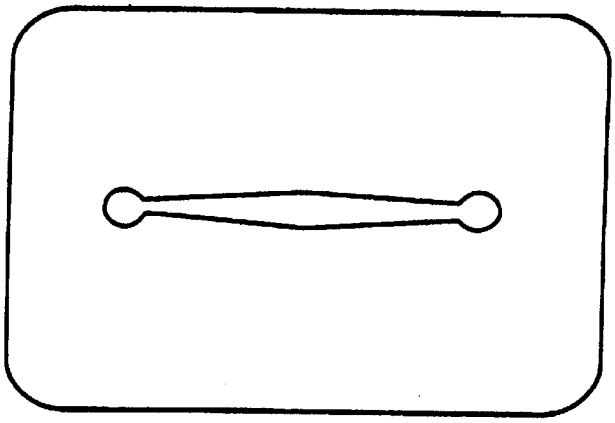

When a resonant slotted structure such as seen in FIG. 4 is exposed to microwave energy, a strong field exists in the central region of the slot. When the same slot (i.e. the same circumferential dimension) is depressed near the ends but having a space between the periphery (see FIGS. 39A and 39B), then the depressed area also generates a high electric field strength, resulting in a more uniform field along the length of the slot.

SUMMARY OF DISCLOSURE

In summary of this disclosure, the present invention provides a novel approach to the construction of microwave packaging structures in which the nature and changes in the nature of the microwave heatable load being heated are taken into consideration to achieve desired microwave heating characteristics and in which a variety of structures, including loop, are tuned to be resonant or anti-resonant to achieve a variety of heating effects in a microwave oven. Modifications are possible within the scope of the invention.

TABLE 2

(Temperatures: ° F.)

| ⊗ | Trial number | meat centre | meat overall | potato | dessert | vegetable |
|---|---|---|---|---|---|---|
| | Multi-compartment meat fitted with a plain retail lid | | | | | |
| | Kenmore/Sanyo microwave oven, 6:00 minutes, full power | | | | | |
| | 1 | 79 | 128 | 162 | 187 | 161 |
| | 2 | 63 | 113 | 155 | 186 | 172 |
| | 3 | 71 | 125 | 146 | 187 | 174 |
| | 4 | 73 | 121 | 188 | 180 | 178 |
| | 5 | 65 | 128 | 98 | 178 | 169 |
| | 6 | 100 | 142 | 162 | 190 | 162 |
| | 7 | 85 | 141 | 161 | 187 | 168 |
| | 8 | 75 | 119 | 171 | 178 | 180 |
| | 9 | 54 | 124 | 168 | 179 | 180 |
| | Average | 74 | 127 | 159 | 183 | 171 |
| | Minimum | 54 | 113 | 98 | 178 | 161 |
| | Maximum | 100 | 142 | 188 | 190 | 180 |
| | Multi-compartment meal fitted with a smart structure lid | | | | | |
| | Kenmore/Sanyo microwave oven, 6:00 minutes, full power | | | | | |
| | 1 | 158 | 169 | 143 | 148 | 149 |
| | 2 | 115 | 147 | 159 | 153 | 140 |
| | 3 | 156 | 167 | 170 | 155 | 158 |
| | 4 | 132 | 152 | 159 | 149 | 142 |
| | 5 | 132 | 152 | 152 | 139 | 147 |
| | 6 | 129 | 144 | 178 | 153 | 156 |
| | 7 | 133 | 142 | 169 | 138 | 149 |
| | 8 | 112 | 139 | 169 | 136 | 146 |
| | 9 | 140 | 155 | 180 | 153 | 160 |
| | Average | 134 | 152 | 164 | 147 | 150 |
| | Minimum | 112 | 139 | 143 | 136 | 140 |
| | Maximum | 158 | 169 | 180 | 155 | 160 |

TABLE 3

SANYO KENMORE MICROWAVE SEPTEMBER (%
Luxtron measurements. Healthy Choice entree

| → | Net weight start | Transparent 1 389.8 | Transparent 2 378.6 | Smart 1 370.1 | Smart 2 358.5 | | |
|---|---|---|---|---|---|---|---|
| | Time (min) | T (° C.) A | T (° C.) B | T (° C.) C | T (° C.) D | Avg A + B | Avg C + D |
| | 0 | −13.7 | −13.2 | −11.2 | −11.4 | −13.45 | −11.3 |
| | 0.5 | −4.9 | −6.2 | −5.8 | −4.7 | −5.55 | −5.25 |
| | 1 | −2.5 | −3.2 | −4.2 | −3.6 | −2.85 | −3.9 |
| | 1.5 | −2 | −1.9 | −1.9 | −2.5 | −1.95 | −2.2 |
| | 2 | −1.6 | −1.3 | −0.9 | −1.6 | −1.45 | −1.25 |
| | 2.5 | −1 | −0.8 | −0.1 | −1 | −0.9 | −0.55 |
| | 3 | −0.7 | −0.6 | 4.4 | 12.3 | −0.65 | 8.35 |
| | 3.5 | −0.4 | −0.3 | 19.1 | 32.5 | −0.35 | 25.8 |
| | 4 | −0.2 | −0.2 | 36.1 | 48.1 | −0.2 | 42.1 |
| | 4.5 | −0.1 | 0.1 | 53.8 | 62.7 | 0 | 58.25 |
| | 5 | 0.3 | 0.5 | 69.8 | 75.5 | 0.4 | 72.65 |
| | 5.5 | 14 | 14.9 | 94 | 89.4 | 14.45 | 91.7 |

TABLE 3-continued

| | SANYO KENMORE MICROWAVE SEPTEMBER (% Luxtron measurements. Healthy Choice entree | | | | | |
|---|---|---|---|---|---|---|
| | Transparent 1 | Transparent 2 | Smart 1 | Smart 2 | | |
| → Net weight start | 389.8 | 378.6 | 370.1 | 358.5 | | |
| Time (min) | T (° C.) A | T (° C.) B | T (° C.) C | T (° C.) D | Avg A + B | Avg C + D |
| 6 | 33 | 49.1 | 100.2 | 98.4 | 41.05 | 99.3 |
| 6.5 | 45.4 | 69.5 | 100.2 | 100.3 | 57.45 | 100.25 |
| 7 | 53 | 77 | 100.2 | 100.3 | 65 | 100.25 |

"SMART" CONTAINER THEORETICAL DESCRIPTION

1. INDIVIDUAL LAYER OF ARBITRARY CROSS-SECTION

This treatment starts with the general form of Maxwell's equations, assuming time-periodicity.

$$\nabla \times E = -j\omega\mu H$$

$$\nabla \times H = j\omega\left(\varepsilon - \frac{j\sigma}{\omega}\right)E$$

For slab loads, and using generalized curvilinear coordinates to describe an arbitrary horizontal plane, operations assume the form $$\nabla \times R = \frac{\hat{u}}{e_v}\left(\frac{\partial R_z}{\partial v} - e_v\frac{\partial R_v}{\partial z}\right) + \frac{\hat{v}}{e_u}\left(e_u\frac{\partial R_u}{\partial z} - \frac{\partial R_z}{\partial u}\right) + \frac{\hat{z}}{e_u e_v}\left(\frac{\partial e_v R_v}{\partial u} - \frac{\partial e_u R_u}{\partial v}\right)$$

$$\nabla \cdot R = \frac{1}{e_u e_v}\left(\frac{\partial e_v R_u}{\partial u} + \frac{\partial e_u R_v}{\partial v}\right) + \frac{\partial R_z}{\partial z}$$

$$\nabla^2 = \frac{1}{e_u e_v}\left[\frac{\partial}{\partial u}\left(\frac{e_v}{e_u}\frac{\partial}{\partial u}\right) + \frac{\partial}{\partial v}\left(\frac{e_u}{e_v}\frac{\partial}{\partial v}\right)\right] + \frac{\partial^2}{\partial z^2}.$$

Using the seperation expression $p^2 - \gamma^2 = \omega^2\mu\varepsilon$, with $\gamma = \alpha + j\beta$, and $$E_z = E_z(u, v)E_z(z) = E_z(u, v)E_{zo}(e^{-\gamma z} + \Gamma e^{\gamma z})$$

$$H_z = H_z(u, v)H_z(z) = H_z(u, v)H_{zo}(e^{-\gamma z} - \Gamma e^{\gamma z})$$

we then obtain the general solutions $$E_u = -\frac{1}{p^2}\left[\frac{\gamma E_{zo}}{e_u}\frac{\partial E(u, v)}{\partial u} + \frac{j\omega\mu H_{zo}}{e_v}\frac{\partial H(u, v)}{\partial v}\right](e^{-\gamma z} - \Gamma e^{\gamma z})$$

$$E_v = -\frac{1}{p^2}\left[\frac{\gamma E_{zo}}{e_v}\frac{\partial E(u, v)}{\partial v} - \frac{j\omega\mu H_{zo}}{e_u}\frac{\partial H(u, v)}{\partial u}\right](e^{-\gamma z} - \Gamma e^{\gamma z})$$

$$H_u = -\frac{1}{p^2}\left[\frac{\gamma H_{zo}}{e_u}\frac{\partial H(u, v)}{\partial u} - \frac{j\omega}{e_v}\left(\varepsilon - \frac{j\sigma}{\omega}\right)E_{zo}\frac{\partial E(u, v)}{\partial v}\right](e^{-\gamma z} + \Gamma e^{\gamma z})$$

$$H_v = -\frac{1}{p^2}\left[\frac{\gamma H_{zo}}{e_v}\frac{\partial H(u, v)}{\partial v} + \frac{j\omega}{e_u}\left(\varepsilon - \frac{j\sigma}{\omega}\right)E_{zo}\frac{\partial E(u, v)}{\partial u}\right](e^{-\gamma z} + \Gamma e^{\gamma z}).$$

Between two bodies designated by subscripts $m$ and $n$, continuity requirements lead to the expressions $$\left[\frac{\gamma_m E_{zom}}{e_u}\frac{\partial E_z(u, v)}{\partial u} + \frac{j\omega\mu_m H_{zom}}{e_v}\frac{\partial H_z(u, v)}{\partial v}\right](e^{-\gamma_m h} - \Gamma_m e^{\gamma_m h}) = \left[\frac{\gamma_n E_{zon}}{e_u}\frac{\partial E_z(u, v)}{\partial u} + \frac{j\omega\mu_n H_{zon}}{e_v}\frac{\partial H_z(u, v)}{\partial v}\right](e^{-\gamma_n h} - \Gamma_n e^{\gamma_n h})$$

-continued $$\left[\frac{\gamma_m E_{zom}}{e_v}\frac{\partial E_z(u,v)}{\partial v}-\frac{j\omega\mu_m H_{zom}}{e_u}\frac{\partial H_z(u,v)}{\partial u}\right](e^{-\gamma_m h}-\Gamma_m e^{\gamma_m h})=\left[\frac{\gamma_n E_{zon}}{e_v}\frac{\partial E_z(u,v)}{\partial v}-\frac{j\omega\mu_n H_{zon}}{e_u}\frac{\partial H_z(u,v)}{\partial u}\right](e^{-\gamma_n h}-\Gamma_n e^{\gamma_n h})$$

$$\left(\varepsilon_m-\frac{j\sigma_m}{\omega}\right)E_{zom}(e^{-\gamma_m h}+\Gamma_m e^{\gamma_m h})=\left(\varepsilon_n-\frac{j\sigma_n}{\omega}\right)E_{zon}(e^{-\gamma_n h}+\Gamma_n e^{\gamma_n h})$$

$$\left[\frac{\gamma_m H_{zom}}{e_u}\frac{\partial H_z(u,v)}{\partial u}-\frac{j\omega}{e_v}\left(\varepsilon_m-\frac{j\sigma_m}{\omega}\right)E_{zom}\frac{\partial E_z(u,v)}{\partial v}\right](e^{-\gamma_m h}+\Gamma_m e^{\gamma_m h})=$$

$$\left[\frac{\gamma_n H_{zon}}{e_u}\frac{\partial H_z(u,v)}{\partial u}-\frac{j\omega}{e_v}\left(\varepsilon_n-\frac{j\sigma_n}{\omega}\right)E_{zon}\frac{\partial E_z(u,v)}{\partial v}\right](e^{-\gamma_n h}+\Gamma_n e^{\gamma_n h})$$

$$\left[\frac{\gamma_m H_{zom}}{e_v}\frac{\partial H_z(u,v)}{\partial v}-\frac{j\omega}{e_u}\left(\varepsilon_m-\frac{j\sigma_m}{\omega}\right)E_{zom}\frac{\partial E_z(u,v)}{\partial u}\right](e^{-\gamma_m h}+\Gamma_m e^{\gamma_m h})=$$

$$\left[\frac{\gamma_n H_{zon}}{e_v}\frac{\partial H_z(u,v)}{\partial v}+\frac{j\omega}{e_u}\left(\varepsilon_n-\frac{j\sigma_n}{\omega}\right)E_{zon}\frac{\partial E_z(u,v)}{\partial u}\right](e^{-\gamma_n h}+\Gamma_n e^{\gamma_n h})$$

$$\mu_m H_{zom}(e^{-\gamma_m h}-\Gamma_m e^{\gamma_m h})=\mu_n H_{zon}(e^{-\gamma_n h}-\Gamma_n e^{\gamma_n h}).$$

This system reduces to the requirement of TM and TE cavity-type modes determined respectiively from $$\gamma_m E_{zom}(e^{-\gamma_m h}-\Gamma_m e^{\gamma_m h})=\gamma_n E_{zon}(e^{-\gamma_n h}-\Gamma_n e^{\gamma_n h})$$

$$\left(\varepsilon_m-\frac{j\sigma_m}{\omega}\right)E_{zom}(e^{-\gamma_m h}+\Gamma_m e^{\gamma_m h})=\left(\varepsilon_n-\frac{j\sigma_n}{\omega}\right)E_{zon}(e^{-\gamma_n h}+\Gamma_n e^{\gamma_n h})$$

and $$\gamma_m H_{zom}(e^{-\gamma_m h}+\Gamma_m e^{\gamma_m h})=\gamma_n H_{zon}(e^{-\gamma_n h}+\Gamma_n e^{\gamma_n h})$$

$$\mu_m H_{zom}(e^{-\gamma_m h}-\Gamma_m e^{\gamma_m h})=\mu_n H_{zon}(e^{-\gamma_n h}-\Gamma_n e^{\gamma_n h}).$$

For TM modes, we obtain the reflection coefficient and field intensity $$\Gamma_m=\frac{\gamma_m\left(\varepsilon_n-\frac{j\sigma_n}{\omega}\right)(e^{-\gamma_n h}+\Gamma_n e^{\gamma_n h})-\gamma_n\left(\varepsilon_m-\frac{j\sigma_m}{\omega}\right)(e^{-\gamma_n h}-\Gamma_n e^{\gamma_n h})}{\gamma_m\left(\varepsilon_n-\frac{j\sigma_n}{\omega}\right)(e^{-\gamma_n h}+\Gamma_n e^{\gamma_n h})+\gamma_n\left(\varepsilon_m-\frac{j\sigma_m}{\omega}\right)(e^{-\gamma_n h}-\Gamma_n e^{\gamma_n h})}e^{-2\gamma_m h}$$

$$E_{zon}=\frac{2\gamma_m\left(\varepsilon_m-\frac{j\sigma_m}{\omega}\right)E_{zom}e^{-\gamma_m h}}{\gamma_m\left(\varepsilon_n-\frac{j\sigma_n}{\omega}\right)(e^{-\gamma_n h}+\Gamma_n e^{\gamma_n h})+\gamma_n\left(\varepsilon_m-\frac{j\sigma_m}{\omega}\right)(e^{-\gamma_n h}-\Gamma_n e^{\gamma_n h})}$$

and for TE modes, we get the terms $$\Gamma_m=\frac{\gamma_n\mu_m(e^{-\gamma_n h}+\Gamma_n e^{\gamma_n h})-\gamma_m\mu_n(e^{-\gamma_n h}-\Gamma_n e^{\gamma_n h})}{\gamma_n\mu_m(e^{-\gamma_n h}+\Gamma_n e^{\gamma_n h})+\gamma_m\mu_n(e^{-\gamma_n h}-\Gamma_n e^{\gamma_n h})}$$

$$H_{zon}=\frac{2\gamma_m\mu_m H_{zom}e^{-\gamma_m h}}{\gamma_n\mu_m(e^{-\gamma_n h}+\Gamma_n e^{\gamma_n h})+\gamma_m\mu_n(e^{-\gamma_n h}-\Gamma_n e^{\gamma_n h})}.$$

From the Poynting expression $$\nabla\cdot(E\times H^*)=j\omega\left(\varepsilon+\frac{j\sigma}{\omega}\right)E\cdot E^*-j\omega\mu H\cdot H^*$$

the corresponding power absorption expressions are $$P_{avg}=\tfrac{1}{2}j\omega\left(\varepsilon^*+\frac{j\sigma}{\omega}\right)E_{zO}E_{zO}^*\int_V\left\{\frac{\gamma\gamma^*}{(pp^*)^2}\left[\frac{1}{e_u{}^2}\frac{\partial E_z(u,v)}{\partial u}\frac{\partial E_z^*(u,v)}{\partial u}+\right.\right.$$

-continued $$\frac{1}{e_v^2}\frac{\partial E_z(u,v)}{\partial v}\frac{\partial E_z^*(u,v)}{\partial v}\Big](e^{\gamma z}-\Gamma e^{\gamma z})(e^{\gamma^* z}-\Gamma^* e^{\gamma^* z})+E_z(u,v)E_z^*(u,v)(e^{\gamma z}+\Gamma e^{\gamma z})(e^{\gamma^* z}+\Gamma^* e^{\gamma^* z})-$$

$$\frac{\omega^2\mu}{(pp^*)^2}\left(\varepsilon-\frac{j\sigma}{\omega}\right)\left[\frac{1}{e_u^2}\frac{\partial E_z(u,v)}{\partial u}\frac{\partial E_z^*(u,v)}{\partial u}+\frac{1}{e_v^2}\frac{\partial E_z(u,v)}{\partial v}\frac{\partial E_z^*(u,v)}{\partial v}\right](e^{\gamma z}+\Gamma e^{\gamma z})(e^{\gamma^* z}+\Gamma^* e^{\gamma^* z})\Bigg\}dV$$

$$P_{avg}=\tfrac{1}{2}j\omega\mu H_{zo}H_{zo}^*\int_V\Bigg\{\frac{\omega^2\mu^*}{(pp^*)^2}\left(\varepsilon^*+\frac{j\sigma}{\omega}\right)\left[\frac{1}{e_u^2}\frac{\partial H_z(u,v)}{\partial u}\frac{\partial H_z^*(u,v)}{\partial u}+\right.$$

$$\left.\frac{1}{e_v^2}\frac{\partial H_z(u,v)}{\partial v}\frac{\partial H_z^*(u,v)}{\partial v}\right](e^{\gamma z}-\Gamma e^{\gamma z})(e^{\gamma^* z}+\Gamma^* e^{\gamma^* z})-H_z(u,v)H_z^*(u,v)(e^{\gamma z}-\Gamma e^{\gamma z})(e^{\gamma^* z}-\Gamma^* e^{\gamma^* z})-$$

$$\frac{\gamma\gamma^*}{(pp^*)^2}\left[\frac{1}{e_u^2}\frac{\partial H_z(u,v)}{\partial u}\frac{\partial H_z^*(u,v)}{\partial u}+\frac{1}{e_v^2}\frac{\partial H_z(u,v)}{\partial v}\frac{\partial H_z^*(u,v)}{\partial v}\right](e^{\gamma z}+\Gamma e^{\gamma z})(e^{\gamma^* z}+\Gamma^* e^{\gamma^* z})\Bigg\}dV.$$

These expressions are cumbersome, and computation requires a knowledge of the transverse differential terms. We would optimally wish to collect the horizontal field terms, so that they can be treated as proportionality constants.

Considering the term $$\left[\frac{1}{e_u^2}\frac{\partial R_z(u,v)}{\partial u}\frac{\partial R_z^*(u,v)}{\partial u}+\frac{1}{e_v^2}\frac{\partial R_z(u,v)}{\partial v}\frac{\partial R_z^*(u,v)}{\partial v}\right]e_u e_v$$

manipulation with the chain rule and integration yields $$\int_S\left[\frac{1}{e_u^2}\frac{\partial R_z(u,v)}{\partial u}\frac{\partial R_z^*(u,v)}{\partial u}+\frac{1}{e_v^2}\frac{\partial R_z(u,v)}{\partial v}\frac{\partial R_z^*(u,v)}{\partial v}\right]dA=$$

$$p^2\int_S R_z(u,v)R_z^*(u,v)dA+\int_o^{vo}\Bigg|_o^{uo}\left(\frac{e_v}{e_u}R_z^*(u,v)\frac{\partial R_z(u,v)}{\partial u}\right)dv+\int_o^{uo}\Bigg|_o^{vo}\left(\frac{e_u}{e_v}R_z^*(u,v)\frac{\partial R_z(u,v)}{\partial v}\right)du.$$

The right hand integrals disappear for PEC and PMC wall conditions, or when there are maxima, minima or zeros at the origin and load boundary. The result resembles that obtained with the two-dimensional Green's theorem.

$$\int_S\left[\frac{1}{e_u^2}\frac{\partial R_z(u,v)}{\partial u}\frac{\partial R_z^*(u,v)}{\partial u}+\frac{1}{e_v^2}\frac{\partial R_z(u,v)}{\partial v}\frac{\partial R_z^*(u,v)}{\partial v}\right]dA=p^2\int_S R_z(u,v)R_Z^*(u,v)dA$$

This leads to the much simpler and easily applied TM and TE power absorption expressions $$P_{avg}=\frac{j\dot{\omega}\gamma}{2p^2}\left(\varepsilon^*+\frac{j\sigma}{\omega}\right)E_{zo}E_{zo}^*\int_V\left[\gamma^*(e^{\gamma z}-\Gamma e^{\gamma z})(e^{\gamma^* z}-\Gamma^* e^{\gamma^* z})+\gamma(e^{\gamma z}+\Gamma e^{\gamma z})(e^{\gamma^* z}+\Gamma^* e^{\gamma^* z})\right]E_z(u,v)E_z^*(u,v)dV$$

$$P_{avg}=-\frac{j\omega\gamma\mu}{2p^2}H_{zo}H_{zo}^*\int_V\left[\gamma^*(e^{\gamma z}-\Gamma e^{\gamma z})(e^{\gamma^* z}-\Gamma^* e^{\gamma^* z})+\gamma(e^{\gamma z}+\Gamma e^{\gamma z})(e^{\gamma^* z}+\Gamma^* e^{\gamma^* z})\right]H_z(u,v)H_z^*(u,v)dV.$$

Taking the reflection coefficient as $\Gamma=\zeta+j\eta$, and $$\gamma^*(e^{\gamma z}-\Gamma e^{\gamma z})(e^{\gamma^* z}-\Gamma^* e^{\gamma^* z})+\gamma(e^{\gamma z}+\Gamma e^{\gamma z})(e^{\gamma^* z}+\Gamma^* e^{\gamma^* z})=2\alpha(e^{-2\alpha z}+(\zeta^2+\eta^2)e^{2\alpha z})+4j\beta[\zeta\cos(2\beta z)-\eta\sin(2\beta z)]$$

finally leads to TM and TE expressions that are easily incorporated in computational algorithms.

$$P_{avg}=\frac{-j\omega\gamma}{2p^2}\left(\varepsilon^*+\frac{j\sigma}{\omega}\right)E_{zo}E_{zo}^*\Bigg|_{ho}^{h1}\{e^{-2\alpha z}-(\zeta^2+\eta^2)e^{2\alpha z}-2j[\zeta\sin(2\beta z)+\eta\cos(2\beta z)]\}\int_S E_z(u,v)E_z^*(u,v)dA$$

-continued $$P_{avg} = \frac{-j\omega\mu\gamma^*}{2p^2} H_{zo} H_{zo}^* \Big|_{ho}^{hl} \{e^{-2\alpha z} - (\zeta^2 + \eta^2)e^{2\alpha z} - 2j[\zeta \sin(2\beta z) + \eta \cos(2\beta z)]\} \int_S H_z(u, v) H_z^*(u, v)\, dA$$

2. COMMENTS ON ALGORITHMS

Computation starts from a lower PEC wall, as that of the oven cavity or a highly reflective container base. Reflection coefficients are calculated and substituted into the successive layers. For a top-feeding system, field amplitudes are iterated downwards. Reflective upper boundaries force specific p values, and their dependence on load design, composition and temperature is obtained by looping through the parameters.

3. LIST OF SYMBOLS

| | |
|---|---|
| Roman Letters | |
| $e^{f(z)}$ | Natural exponential function of argument f(z) |
| $e_u$, $e_v$, $e_w$ | Metric coefficients corresponding to generalized curvilinear coordinates u, v and w |
| j | $\sqrt{-1}$ |
| p | Transverse wave number |
| t | Time |
| u, v, w, z | Generalized curvilinear coordinates |
| $\hat{u}$, $\hat{v}$, $\hat{w}$, $\hat{z}$ | Unit vectors corresponding to generalized curvilinear coordinates |
| E | Electric field intensity vector |
| $E_u$, $E_v$, $E_z$ | Electric field intensity u, v, and z scalar components |
| $E_z(u,v)$, $E_z(z)$ | Transverse and penetration-axis parts of electric field intensity z scalar component |
| $E_{zo}$ | Amplitude of penetration-axis part of electric field intensity z component |
| H | Magnetic field intensity vector |
| $H_u$, $H_v$, $H_z$ | Magnetic field intensity u, v and z scalar components |
| $H_z(u,v)$, $H_z(z)$ | Transverse and penetration-axis parts of magnetic field intensity z scalar component |
| $H_{zo}$ | Amplitude of penetration-axis part of magnetic field intensity z component |
| $P_{avg}$ | Power absorption, as RMS time-average |
| R | Vector generalizing electric or magnetic field intensities |
| $R_u$, $R_v$, $R_z$ | Scalar u, v, and z components of generalized vector |
| $R_z(u,v)$ | Transverse part of z scalar components of generalized vector |
| Greek Letters | |
| $\alpha$ | Penetration axis attenuation per unit length |
| $\beta$ | Penetration axis phase shift per unit length |
| $\gamma$ | Penetration axis propagation factor |
| $\epsilon$ | Electric permittivity |
| $\epsilon_o$ | Free space permittivity |
| $\epsilon_r$ | Relative permittivity, or dielectric constant |
| $\epsilon'$, $\epsilon''$ | Real and complex parts of dielectric constant |
| $\zeta$, $\eta$ | Real and complex parts of reflection coefficient in penetration axis |
| $\mu$ | Magnetic permeability |
| $\mu_0$ | Free space permeablity |
| $\mu_r$ | Relative permeability |
| $\mu'$, $\mu''$ | Real and complex parts of permeability |
| $\sigma$ | Conductivity |
| $\omega$ | Angular frequency |
| $\Gamma$ | Reflection coefficient in penetration axis |
| Constants | |
| $\epsilon_o$ | $8.854187817 \ldots \cdot 10^{-12}$ $Fm^{-1}$ |
| $\mu_o$ | $12.566370614 \ldots \cdot 10^{-7}$ $F^{-1}m^{-1}s^2$ |

What we claim is:

1. A control element capable of modifying the microwave heating of a microwave heatable load, said control element having microwave reflective boundaries corresponding to a shape selected from closed loops and annular slots;

said boundaries providing guidance of microwaves leading to specific interference effects by interaction with the microwave heatable load, with dielectric materials when adjacent thereto, and with dielectric components of a microwave cavity or oven when the said control element is located beneath said load and when the load and element are supported thereby, said microwave reflective boundaries being formed by variation of constitutive parameters across the boundaries of the control element to provide contiguous regions with differing constitutive parameters selected from differing dielectric constants, differing magnetic permeabilities, and differing conductivities between the regions, and said interference effects being selected from constructive interference to provide resonant intensification of the microwave fields for intensification of microwave heating of the load, and from destructive interference to provide anti-resonant reduction of microwave field intensities for reduced microwave heating of the load, the said control element being shaped in the form of a closed loop or annular slot whose mean circumference s is given by $$s = n\lambda_o / 2\sqrt{\epsilon_{eff}}$$

n is the mode order, and for resonance n is an even positive non-zero integer, and for anti-resonance n is an odd positive integer, and $\epsilon_{eff}$ is the effective dielectric constant adjacent to the element, and $\lambda_o$ is the free space wavelength of the microwaves.

2. A control element as claimed in claim 1 in thermal contact with a susceptor, in which the boundaries provide guidance of microwaves leading to specific interference effects by interaction with the microwave heatable load and susceptor, said interference effects being selected from constructive interference to provide resonant intensification of the microwave fields for intensification of microwave heating of the load and the susceptor, and from destructive interference to provide anti-resonant reduction of microwave field intensities for reduced microwave heating of the load and the susceptor.

3. A control element capable of modifying the microwave heating of a microwave heatable load, said control element having microwave reflective boundaries corresponding to a shape selected from open strips or slots;

said boundaries providing guidance of microwaves leading to specific interference effects by interaction with the microwave heatable load, with dielectric materials when adjacent thereto, and with dielectric components of a microwave cavity or oven when the said control element is located beneath said load and when the load and element are supported thereby, said microwave reflective boundaries being formed by variation of constitutive parameters across the boundaries of the control element to provide contiguous regions with differing constitutive parameters selected from differing dielectric constants, differing magnetic permeabilities, and differing conductivities between the regions, and said interference effects being selected from constructive interference to provide resonant intensification of the microwave fields for intensification of microwave heating of the load, and from destructive interference to provide anti-resonant reduction of microwave field intensities for reduced microwave heating of the load, the said control element being shaped in the form of an open strip or slot whose length s is given by $$s=n\lambda_o/2\sqrt{\epsilon_{eff}}$$

n is the mode order, and for resonance n is a positive non-zero integer, and $\epsilon_{eff}$ is the effective dielectric constant adjacent to the element, and $\lambda_o$ is the free space wavelength of the microwaves.

4. A control element as claimed in claim 3 in thermal contact with a susceptor, in which the boundaries provide guidance of microwaves leading to specific interference effects by interaction with the microwave heatable load and susceptor, said interference effects being selected from constructive interference to provide resonant intensification of the microwave fields for intensification of microwave heating of the load and the susceptor, and from destructive interference to provide antiresonant reduction of microwave field intensities for reduced microwave heating of the load and the susceptor.

5. A control element capable of modifying the microwave heating of a microwave heatable load, said control element having microwave reflective boundaries corresponding to a shape selected from monopole strips or slots;

said boundaries providing guidance of microwaves leading to specific interference effects by interaction with the microwave heatable load, with dielectric materials when adjacent thereto, and with dielectric components of a microwave cavity or oven when the said control element is located beneath said load and when the load and element are supported thereby, said microwave reflective boundaries being formed by variation of constitutive parameters across the boundaries of the control element to provide contiguous regions with differing constitutive parameters selected from differing dielectric constants, differing magnetic permeabilities, and differing conductivities between the regions, and said interference effects being selected from constructive interference to provide resonant intensification of the microwave fields for intensification of microwave heating of the load, and from destructive interference to provide anti-resonant reduction of microwave field intensities for reduced microwave heating of the load, the said control element being shaped in the form of a monopole strip or slot whose length s is given by $$s=(2k+1)\lambda_o/4\sqrt{\epsilon_{eff}}$$

k is zero or a positive integer, and $\epsilon_{eff}$ is the effective dielectric constant adjacent to the element, and $\lambda_o$ is the free space wavelength of the microwaves.

6. A control element as claimed in claim 5 in thermal contact with a susceptor, in which the boundaries provide guidance of microwaves leading to specific interference effects by interaction with the microwave heatable load and susceptor, said interference effects being selected from constructive interference to provide resonant intensification of the microwave fields for intensification of microwave heating of the load and the susceptor, and from destructive interference to provide anti-resonant reduction of microwave field intensities for reduced microwave heating of the load and the susceptor.

7. A method of controlling the heating of a microwave heatable load by microwave radiation, which comprises positioning a control element capable of modifying the microwave heating of a microwave heatable load when proximal thereto, and capable of providing reduced scorching of adjacent lossy packaging materials when a microwave heatable load is not proximal thereto, said control element having microwave reflective boundaries corresponding to a shape selected from closed loops or annular slots;

said boundaries providing guidance of microwaves leading to destructive interference effects when said active element is not proximal to a microwave heatable load, by interaction with lossy packaging materials, and with dielectric components of microwave cavity or oven when the said control element is located thereon and supported thereby, said microwave reflective boundaries being formed by variation of constitutive parameters across the boundaries of the control element to provide contiguous regions with differing constitutive parameters selected from differing dielectric constants, differing magnetic permeabilities, and differing conductivities between the regions, and said destructive interference effects providing anti-resonant reduction of microwave field intensities for reduced microwave heating or scorching of said adjacent lossy packaging materials when a microwave heatable load is not proximal thereto, the said control element being shaped in the form of a closed loop or annular slot whose mean circumference s is given by $$s=n\lambda_o/2\sqrt{\epsilon_{eff}}$$

n is the mode order, and for resonance n is an even positive non-zero integer, and for anti-resonance n is an odd positive integer, and $\epsilon_{eff}$ is the effective dielectric constant adjacent to the element, and $\lambda_o$ is the free space wavelength of the microwaves.

exposing said microwave heatable load to a heating cycle of microwave radiation to heat the load, and controlling the microwave heating of the load by modifying cooperatively the distribution of microwave heating in a preset pattern in dependence on the shape and dimensions of the control element.

8. A method of controlling microwave heating of a microwave heatable body by microwave radiation, which comprises:

positioning at least one control element at least proximate to one or more faces of a microwave heatable load and a susceptor, said element having microwave reflective boundaries corresponding to a shape selected from strips, loops, patches, slots, apertures and combinations thereof, said boundaries providing guidance of microwaves leading to specific interference effects by interaction with the microwave heatable load and susceptor, with dielectric materials when adjacent thereto, and with dielectric components of a microwave cavity or oven when the said control element and susceptor are located beneath said load and when the load, element, and susceptor are supported thereby, said microwave reflective boundaries being formed by variation of constitutive parameters across the boundaries of the control element to provide contiguous regions with differing constitutive parameters selected from differing dielectric constants, differing magnetic permeabilities, and differing conductivities between the regions, said interference effects being selected from constructive interference to provide resonant intensification of the microwave fields for intensification of microwave heating of the load and susceptor, and from destructive interference to provide anti-resonant reduction of microwave field intensities for reduced microwave heating of the load and susceptor, exposing said microwave heatable load to a heating cycle of microwave radiation to heat the load, and controlling the microwave heating of the load by modifying cooperatively the distribution of microwave heating in a preset pattern in dependence on the shape and dimensions of the control element.

9. A method of controlling microwave heating of a microwave heatable body by microwave radiation, which comprises:

positioning a plurality of control elements at least proximate to one or more faces of a microwave heatable load, said elements having microwave reflective boundaries corresponding to a shape selected from strips, loops, patches, slots, apertures and combinations thereof, said boundaries providing guidance of microwaves leading to specific interference effects by interaction with the microwave heatable load, with dielectric materials when adjacent thereto, and with dielectric components of a microwave cavity or oven when the said control element is located beneath said load and when the load and element are supported thereby, said microwave reflective boundaries being formed by variation of constitutive parameters across the boundaries of the control element to provide contiguous regions with differing constitutive parameters selected from differing dielectric constants, differing magnetic permeabilities, and differing conductivities between the regions, and said interference effects being selected from constructive interference to provide resonant intensification of the microwave fields for intensification of microwave heating locally within the load, and from destructive interference to provide anti-resonant reduction of microwave field intensities for locally reduced microwave heating of the load, exposing said microwave heatable load to a heating cycle of microwave radiation to heat the load, and modifying cooperatively the distribution of microwave heating in the microwave heatable load in a preset pattern by coupling the microwave fields of said individual control elements by field coupling means selected from direct connection of the elements, and from linkage of the fields across separating dielectric material and air gaps when the elements are exposed.

10. A method of controlling microwave heating of a microwave heatable body by microwave radiation as claimed in claim 9 in which the plurality of control elements is positioned proximate to one or more faces of a microwave heatable load and a susceptor, and in which said boundaries provide guidance of microwaves leading to specific interference effects by interaction with the microwave heatable load and the susceptor, said interference effects being selected from constructive interference to provide resonant intensification interference to provide resonant intensification of the microwave fields for intensification of microwave heating locally within the load and susceptor, and from destructive interference to provide anti-resonant reduction of microwave field intensities for locally reduced microwave heating of the load and susceptor.

11. A method of reducing scorching of lossy packaging materials that incorporate control elements for modifying the microwave heating of proximal microwave heatable loads, when the microwave heatable loads are not proximal thereto, which method comprises:

positioning at least one control element at least proximate to one or more faces of a lossy packaging material, said element having microwave reflective boundaries corresponding to a shape selected from strips, loops, patches, slots, apertures and combinations thereof, said boundaries providing guidance of microwaves leading to destructive interference effects when said control element is not proximal to a microwave heatable load, by interaction with said adjacent lossy packaging materials, and with dielectric components of a microwave cavity or oven when the said control element is located thereon and supported thereby, said microwave reflective boundaries being formed by variation of constitutive parameters across the boundaries of the control element to provide contiguous regions with differing constitutive parameters selected from differing dielectric constants, differing magnetic permeabilities, and differing conductivities between the regions, said destructive interference effects providing anti-resonant reduction of microwave field intensities for reduced microwave heating or scorching of said adjacent lossy packaging materials when a microwave heatable load is not proximal thereto, exposing said lossy packaging material to a heating cycle of microwave radiation, and reducing scorching of the lossy packaging material in a preset pattern according to the shape and dimensions of the control element, and in dependence on the proximity of a microwave heatable load.

* * * * *